US008657155B2

(12) United States Patent
Dwork et al.

(10) Patent No.: US 8,657,155 B2
(45) Date of Patent: Feb. 25, 2014

(54) SINGLE UNIT DISPENSING CAP

(76) Inventors: Joshua Dwork, Santa Rosa, CA (US); Hubert Yeung, Santa Rosa, CA (US); Paul Dwork, Camarillo, CA (US)

( * ) Notice: Subject to any disclaimer, the term of this patent is extended or adjusted under 35 U.S.C. 154(b) by 144 days.

(21) Appl. No.: 13/281,306

(22) Filed: Oct. 25, 2011

(65) Prior Publication Data

US 2012/0103985 A1 May 3, 2012

Related U.S. Application Data

(60) Provisional application No. 61/455,869, filed on Oct. 28, 2010.

(51) Int. Cl.
*B65D 47/08* (2006.01)

(52) U.S. Cl.
USPC ..... 221/263; 221/288; 221/229; 221/249

(58) Field of Classification Search
USPC ..... 221/288, 263, 298, 247, 248, 249, 229
See application file for complete search history.

(56) References Cited

U.S. PATENT DOCUMENTS

| | | | | |
|---|---|---|---|---|
| 3,942,683 | A * | 3/1976 | Haas | 221/229 |
| 4,311,251 | A * | 1/1982 | Sternberg | 221/24 |
| 4,530,447 | A * | 7/1985 | Greenspan | 221/288 |
| 4,653,668 | A * | 3/1987 | Gibilisco et al. | 221/298 |
| 5,080,258 | A * | 1/1992 | Hinterreiter | 221/198 |
| 6,267,265 | B1 * | 7/2001 | Issa | 221/288 |
| 6,948,634 | B2 * | 9/2005 | Evans et al. | 221/202 |
| 7,810,673 | B2 * | 10/2010 | Lancesseur et al. | 221/265 |
| 2002/0166869 | A1 * | 11/2002 | Janes Autonell | 221/263 |
| 2005/0029154 | A1 | 2/2005 | Kahn | |
| 2010/0133139 | A1 | 6/2010 | Lowe | |

OTHER PUBLICATIONS

Written Opinion and Search Report of International Application No. PCT/US2011/001824 mailed May 25, 2012.

* cited by examiner

*Primary Examiner* — Patrick Mackey
(74) *Attorney, Agent, or Firm* — Koppel, Patrick, Heybl & Philpott; Michael J. Ram

(57) ABSTRACT

A cap for a container configured for dispensing single items, such as pills, held in said container. The cap channel extends from an upper surface to a lower end providing a passageway through the cap to allow for a predetermined quantity of items to be transferred through a port in an upper portion of the cap. The cap has a lid moveable from a closed position to an open position. In its closed position dispensing of items is prevented; in its open position at least one item is dispensed through the port. A gate is operable, in a first orientation to partially block the passageway and, in a second orientation, to unblock the passageway to allow a preset number of items, to pass through. Alternatively, a diverter is incorporated to control flow of the contents.

15 Claims, 32 Drawing Sheets

SINGLE UNIT DISPENSING CAP

This application claims benefit of U.S. Provisional Application 61/455,869, filed Oct. 28, 2010.

BACKGROUND OF THE INVENTION

The present invention relates to containers that are designed to hold pills, candy, or other tablet shaped items for dispensing. More specifically, the present invention is a novel replacement for the traditional cap typically placed on such containers. The new cap allows a user to dispense a single pill, candy piece, tablet, capsule, nut, bolt and other small item or part. As used herein, the word "pill" is used to generally designate any of the previously listed items or any small part to be dispensed as a single unit.

With regard to pill bottles, the current traditional design consists of a bottle with a closed base and a cap covering an opening at its top. It is typical that the cap is connected to the bottle via screw threads or is a snap fit. For a user to obtain a pill from the bottle the cap must first be removed by unscrewing or unsnapping it, and then pills are usually poured into the free hand or onto a table top or suitable open surface where a single unit is selected. The rest are then placed back into the bottle and the cap is then placed back on the bottle by screwing it to or snapping over the opening.

As the population of the world grows and people live longer, there is an ever increasing aging population. With old age come many dexterity related ailments such as arthritis and loss of strength. Often times, the opening of a traditional pill bottle can be a difficult task for an aging population that may consume more pills or tablets than any other segment of the population. It is this segment of the population that may benefit most from a simple ergonomic pill dispenser that can be easily used, even with only one hand. It would be even more beneficial if the pill dispenser enabled the user to dispense only a single pill from the bottle with each actuation.

This task of dispensing a pill is not only performed by aging individuals but by all other age groups totaling millions of people around the world. Further, this task is sometimes performed several times a day and while it may be common and considered routine, it is clear that the current traditional pill bottle cap design is efficient for the containment of pills but not efficient for the dispensing of pills. In the case of an industrial or production line application where numerous dispensing operations are required, typical dispensing bottles may result in a loss of productivity or may cause ergonomic issues. There are other examples where the contents of the bottle are hazardous for a person to touch and dispensing the contents requires the user to wear protective gear such as gloves because the container provides no other means of safe dispensing.

While other designs have demonstrated ways of accomplishing the task of easily dispensing a single pill from a pill bottle, they have not addressed the complicated task of aligning non-spherical pills or odd shaped items to facilitate reliable and controlled dispensing in a simple user friendly design. As indicated above, while the container and dispensing cap assembly described herein can be used for dispensing various different items, for simplicity the dispensing cap and bottle is illustrated by reference to a single application, the dispensing of a pill shaped object. However, one skilled in the art will recognize that applications for use of the described product are not so limited and the product can be used to dispense a single unit of numerous different items.

SUMMARY

Described herein is a dispensing cap that facilitates reliable and controlled single unit dispensing of pills, candy, tablets, capsules, nuts, bolts and other small items or parts. The invention may be a cap for replacement of the traditional cap which connects to a bottle via threads or a snap fit. The cap may also be adjustable to provide universal adaptability for fitting on bottles with different mouth openings by, for example, a clamping or securing mechanism which mates the cap to the bottle.

The new and innovative cap design comprises an optional pill deflector at the cap inlet attached to a funnel leading into a channel with a moveable gate and a lid which provides an air tight seal at the cap outlet. The seal that is created by the lid is a preferred feature to keep pills or other contents dry and effective. Contained within the channel of the cap is a gate that is opened or closed by the motion of the lid or in an alternative embodiment a separate gate activator, the gate metering the dispensing of pills. A child resistant lock can be incorporated into the design. The cap is designed to reliably dispense any shape item using only one hand while providing a sealable moisture barrier to the bottle or container.

DETAILED DESCRIPTION

Figure 1:
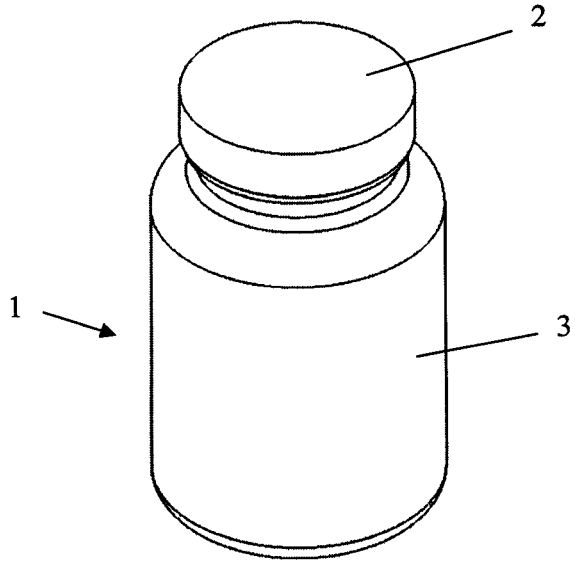
FIG. 1 is a perspective view of a traditional pill bottle with the screw cap attached.
Figure 2:
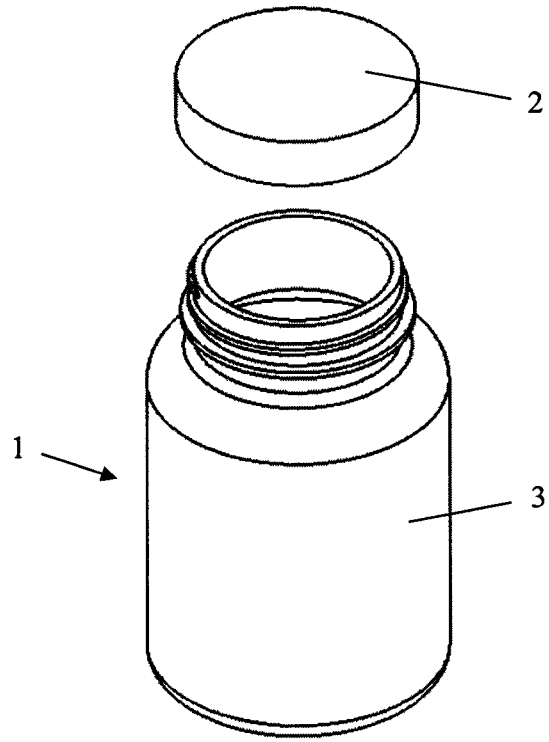
FIG. 2 is a perspective view of the traditional pill bottle of FIG. 1 with the screw cap detached.

Traditional pill bottles consist of a container and a cap. Referring to FIGS. 1 and 2, there is shown a traditional pill bottle 1 that is comprised of a round container 3 and an attached cap 2. This figure is shown only as a reference for the present invention.

Figure 3:
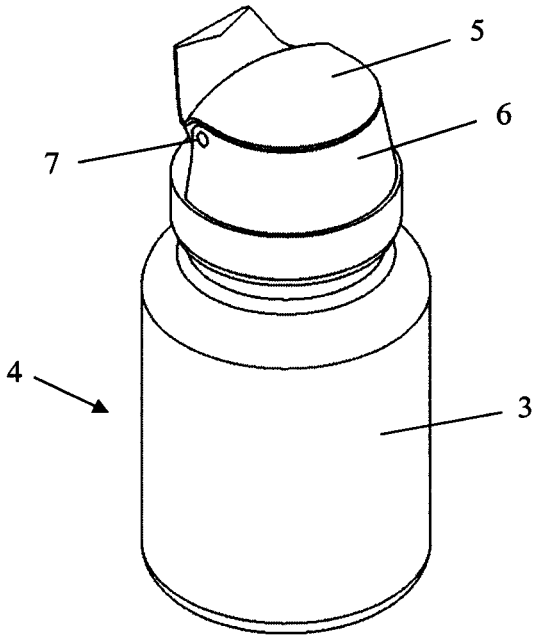
FIG. 3 is a perspective view of a bottle and cap incorporating features of the invention with the cap attached and lid closed.
Figure 4:
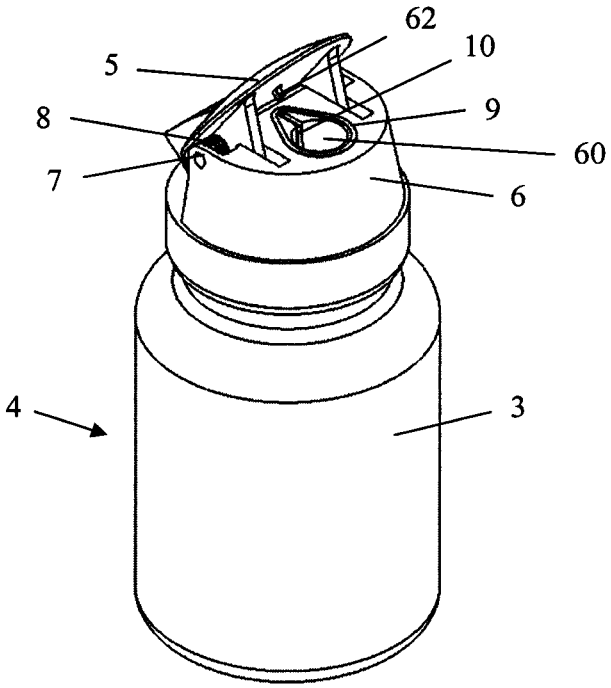
FIG. 4 is a perspective view of the bottle and cap of FIG. 3 with the cap attached and lid open.

To enable simple dispensing of a single pill, the action of holding the bottle and opening the cap or lid is preferably accomplished with using one hand so the other hand can be free to receive the dispensed pill. Referring to FIGS. 3 and 4, shown is a bottle and cap 4, the cap incorporating features of the invention, comprising a funnel cap 6 attached to a round container 3. The funnel cap 6 is spring loaded in the closed position with a torsion spring 8 and a lid 5 pivoting about a hinge pin 7. The lid closes and seals against an optional seal 9 that encircles the end of a pill channel 60 exiting through the funnel cap 6. Contained within the pill channel 60 of the funnel cap 6, is an optional gate 10 that meters the pills for individual dispensing (allows only one pill to be dispensed per lid opening).

Figure 5:
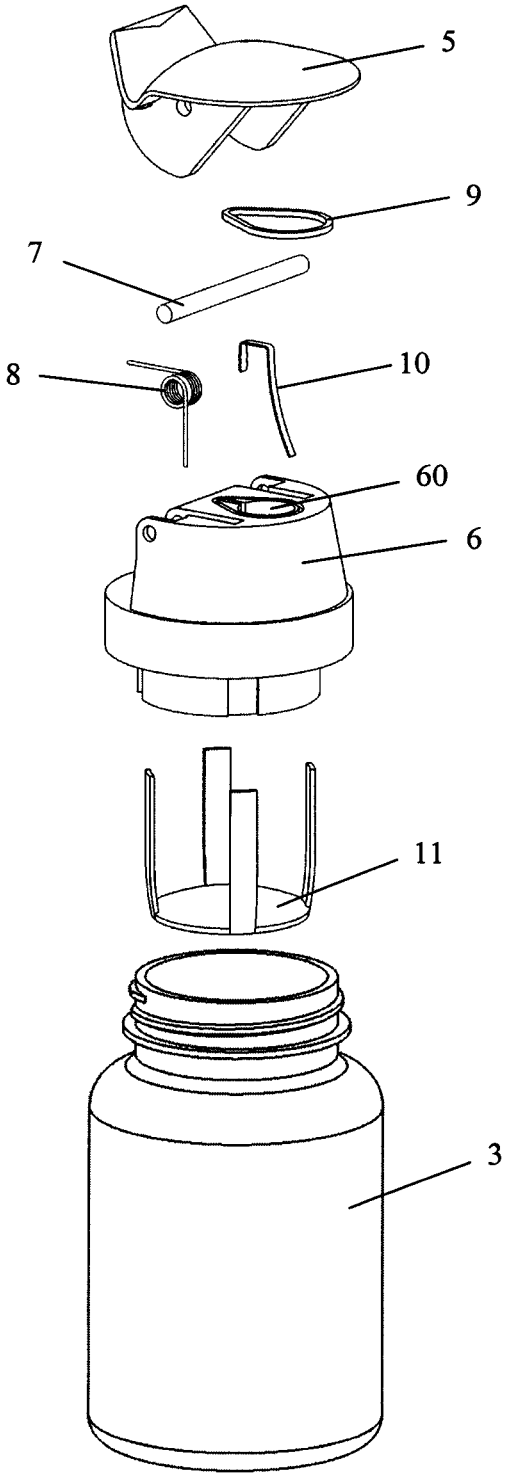
FIG. 5 is an exploded perspective view of the bottle and cap of FIG. 3.
Figure 47:
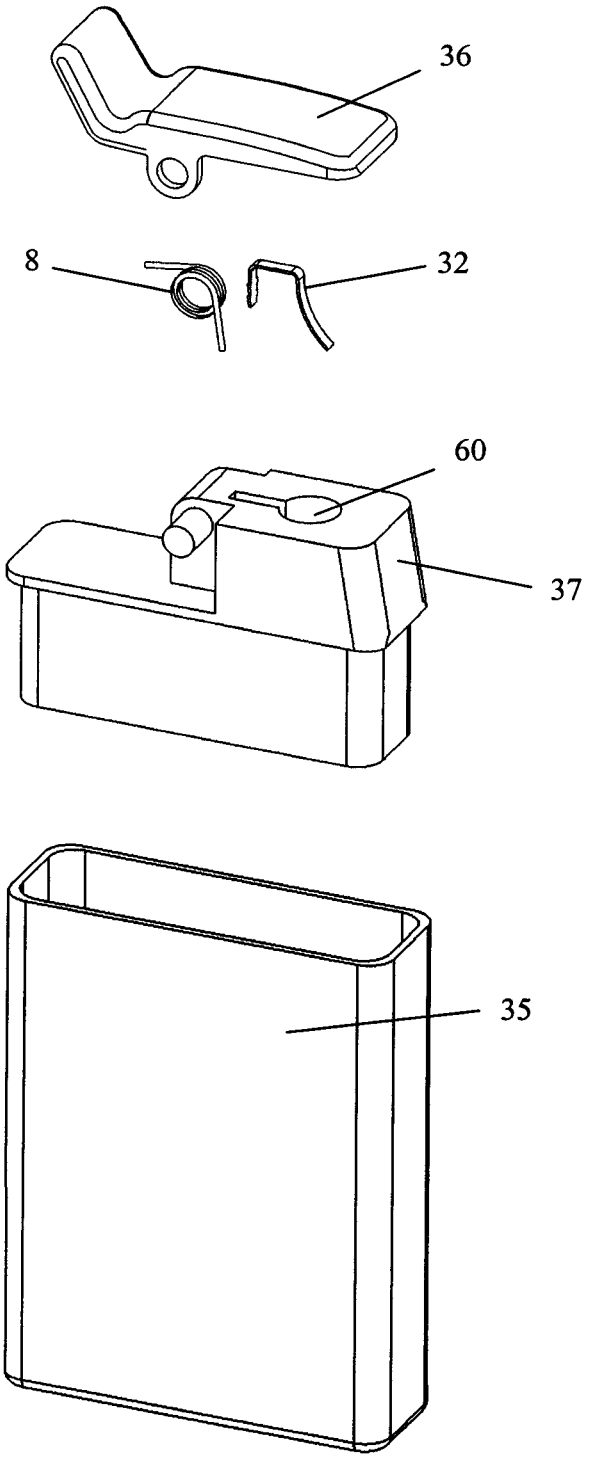
FIG. 47 is an exploded perspective view of the alternate embodiment of FIG. 46.

FIG. 5 is an exploded view showing all of the parts of the embodiment of FIG. 4. Not visible in FIG. 3 is the pill deflector 11 which may generally reside inside of the round container 3. The parts shown in FIG. 5 depict a simple assembly of parts to generally necessary provide functionality. For example, the hinge pin 7 can be omitted if the hinge-like feature is incorporated into the lid 5 or funnel cap 6 as a mating interface between these two parts. An example of this construction is shown in FIG. 47 where the pin is part of the cap 37 and the lid 36 is elastically expanded and snap fit over the cap 37.

Referring to FIG. 5, it is possible that the seal 9 may be omitted if a moisture barrier is not needed or if the lid 5 adequately seals the channel 60 of the funnel cap 6. An example is the use of a low durometer material attached or over molded to the lid 5, which eliminates the need for a separate sealing part. If the separate seal 9 is used as shown in FIG. 5, examples of a suitable material are a low durometer elastomer or silicone rubber. It is also possible that the torsion spring 8 may be incorporated into the lid 5, thereby not requiring a separate part. As it is shown, the lid 5, funnel cap 6 and pill deflector 11 may be constructed out of plastic. Other materials are also useable but because these may be molded parts, plastic is a preferred material. The pill deflector 11, if required, may also be made from a metal such as a wire. The hinge pin 7, if needed, may also be made from plastic or metal. The spring 8 can also be constructed from metal because of its elastic requirements. The gate 10 is preferably constructed from a metal material because of its stability and high elastic modulus properties but can also be plastic. A plastic gate 10 can be integrated into the lid 5 or cap 6 so that it is retracted away from the channel 60 when the lid 5 is closed and is advanced into the channel 60 when the lid 5 is open. The advantage of this integral construction is that the assembled part count is reduced which, in turn, can reduce costs can. However, an advantage of providing the gate 10 as a separate own part is that different gates 10 can be used on the same lid 5 and cap 6 to accommodate different pill shapes and sizes as well as the ability to select a different material for both the lid 5 and cap 6 to optimize their function.

Figure 6:
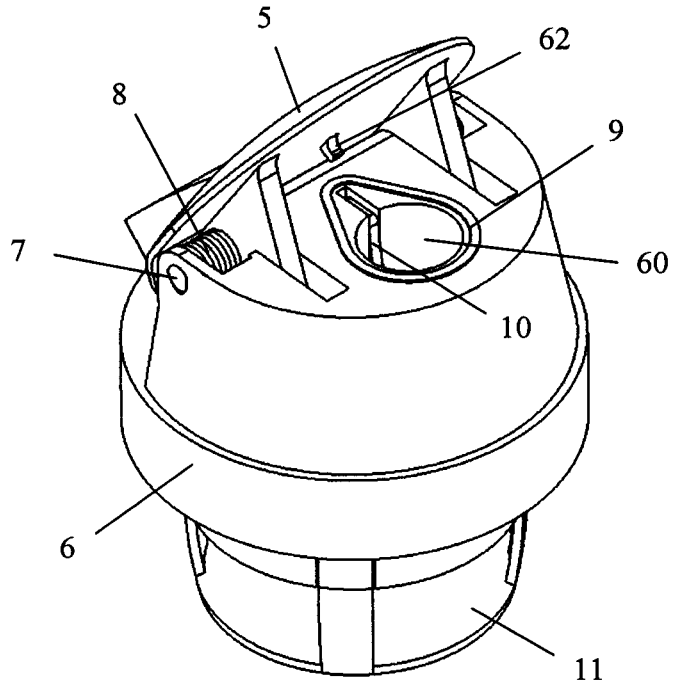
FIG. 6 is a perspective view of the cap shown in FIGS. 3 and 4 with the lid open.
Figure 7:
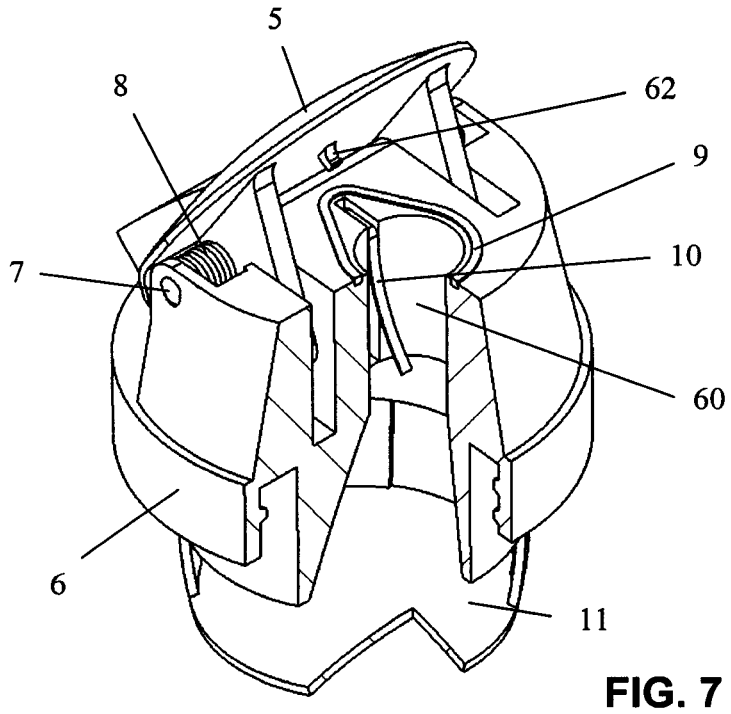
FIG. 7 is a perspective sectional cutaway view of the cap with the lid open.
Figure 8:
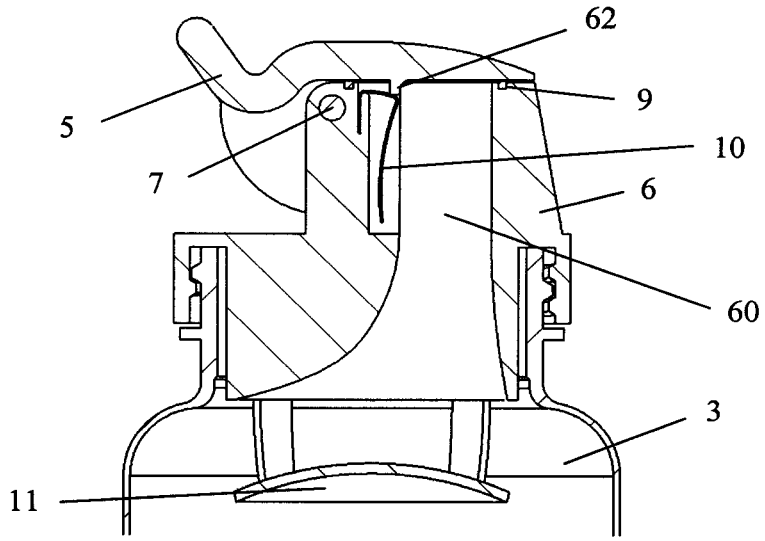
FIG. 8 is a side sectional view of the cap with the lid closed and gate open.
Figure 9:
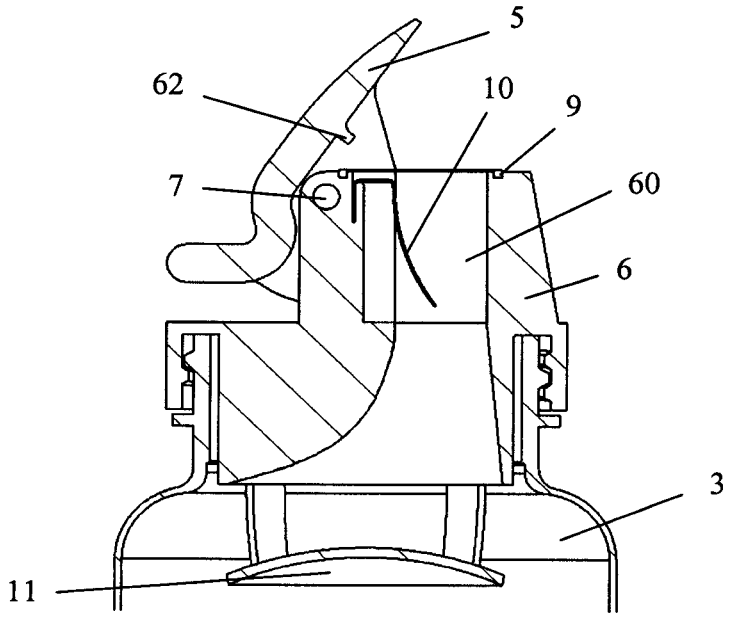
FIG. 9 is a side sectional view of the cap with the lid open and gate closed.

Referring to FIGS. 6 and 7, the lid 5 has a small protrusion 62 on the underside which interacts with the gate 10. This protrusion 62 activates the opening and closing of the gate 10, thereby metering the controlled dispensing of pills 12. FIGS. 8 and 9 show the activation of the gate 10 by the closing of the lid 5 which causes the protrusion 62 to contact the gate 10 and the gate 10 to open. When the gate 10 is open, the pill channel 60 in the cap 6 is clear for pills 12 to line up. When the lid 5 is open and the gate 10 is no longer held closed by the protrusion 62 on the lid 5, the gate 10 closes and blocks the channel 60 of the cap 6, thus preventing any additional pills 12 from passing. Alternatively, a gate 10, which does not obstruct the channel 60 when the lid is closed, can extend from the lid 5 into the channel 60 when the lid is open. It can be integrated into the cap 5 and actuated similar to an externally inserted gate.

Figure 10:
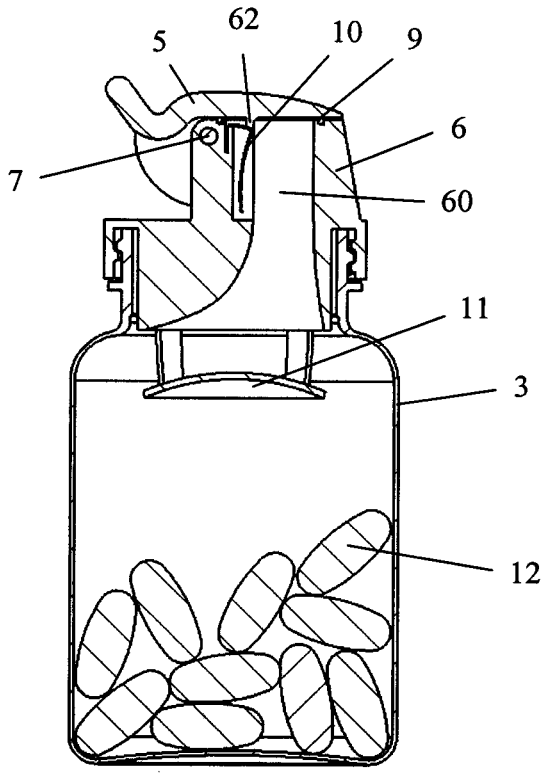
FIG. 10 is a side sectional view of the cap on a container with pills inside the container and the lid closed.
Figure 11:
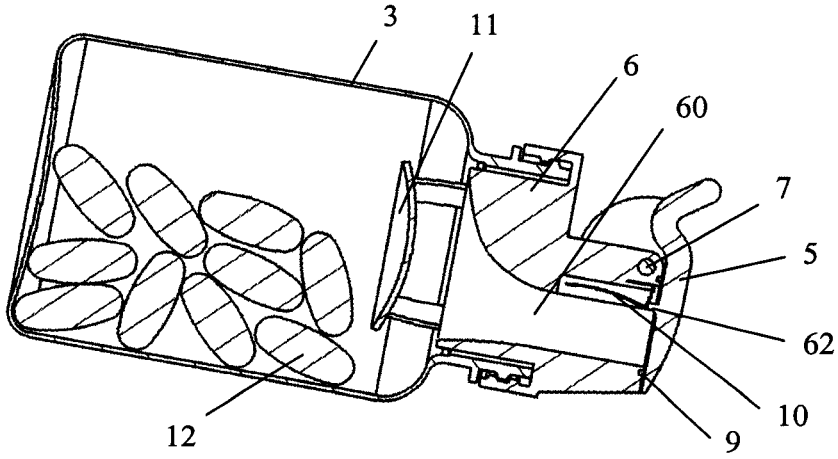
FIG. 11 is a side sectional view of the cap and a container of FIG. 10 in a tilted orientation.

FIG. 10 shows a section view at the start of the dispensing process. A round container 3, filled with cylindrically shaped pills 12, is shown standing upright, as it would appear on a counter or table. To dispense a pill 12 the container 3 is picked up and tipped upside down. FIG. 11 shows the container 3 tilted sideways with the pills 12 beginning to shift from the bottom of the container 3 to the side.

Figure 12:
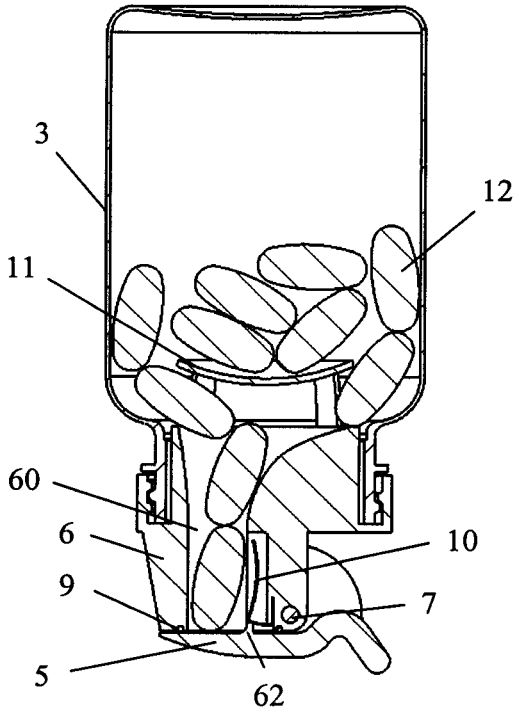
FIG. 12 is side sectional view of the cap and container of FIG. 10 in an upside down orientation.

FIG. 12 is a section view of the container 3 tipped upside down with the pill deflector 11 preventing the jamming of all the pills 12 into the inlet of the cap 6. By only allowing a few pills 12 to pass, the chances of at least one pill 12 making it to the channel 60 are greatly increased. If the pill deflector 11 is not present, the jammed pills 12 can require the user to shake of otherwise agitate the container 3 to free up the jammed pills 12. A user can become frustrated if multiple attempts are required to dispense a single pill 12. The funnel of the cap 6 can also be seen channeling and aligning the pills 12 into the channel 60 of the cap. This increases the reliability of the invention by making sure that any pill 12 that reaches the inlet of the cap 6 is orientated correctly for proper metering of the gate 10.

Figure 13:
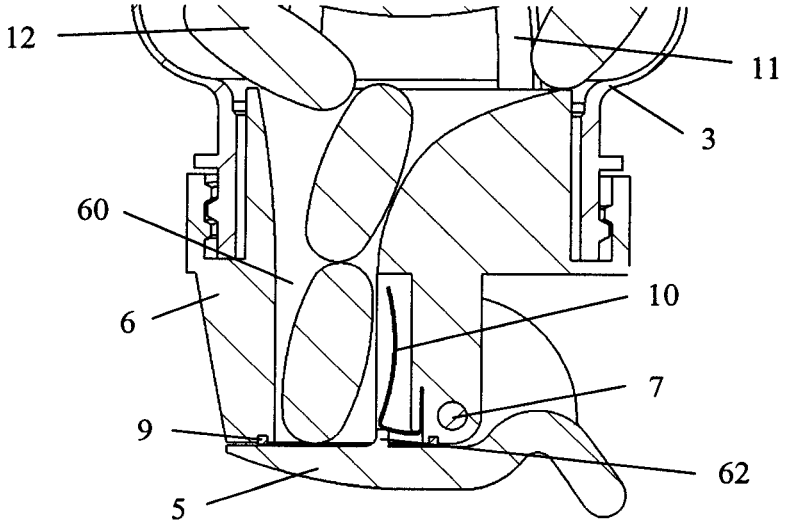
FIG. 13 is an enlarged side view of the cap and a container as shown in FIG. 12.
Figure 14:
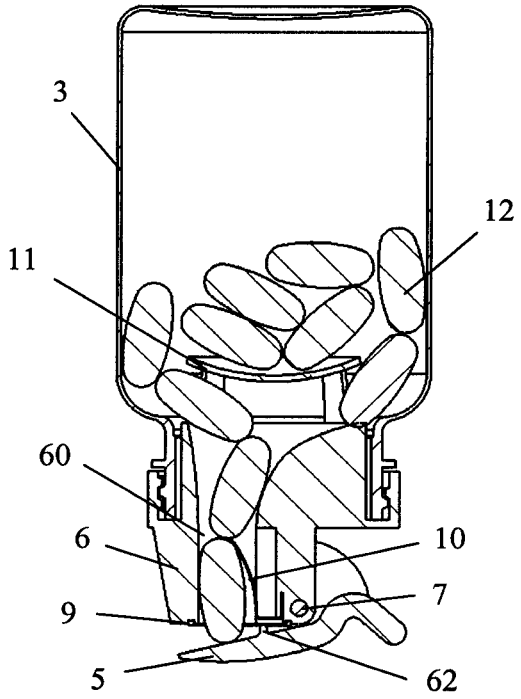
FIG. 14 is a side partial sectional view of the cap and container as shown in FIG. 12 with the lid partially open.
Figure 15:
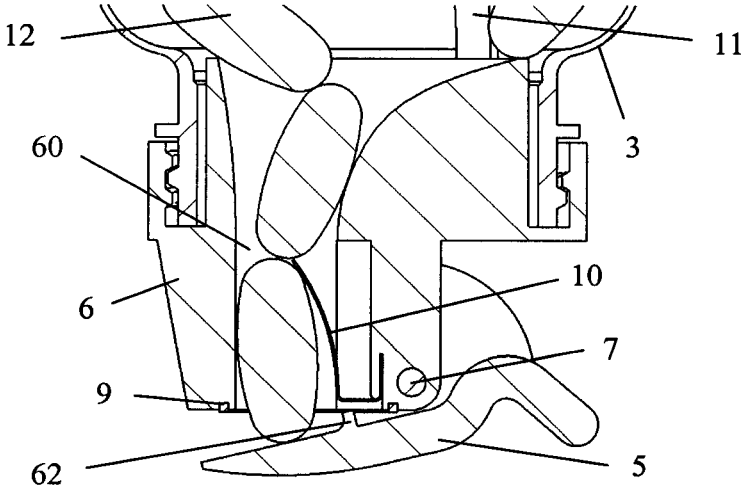
FIG. 15 is an enlarged side view of the partially open cap and container as shown in FIG. 14.
Figure 39:
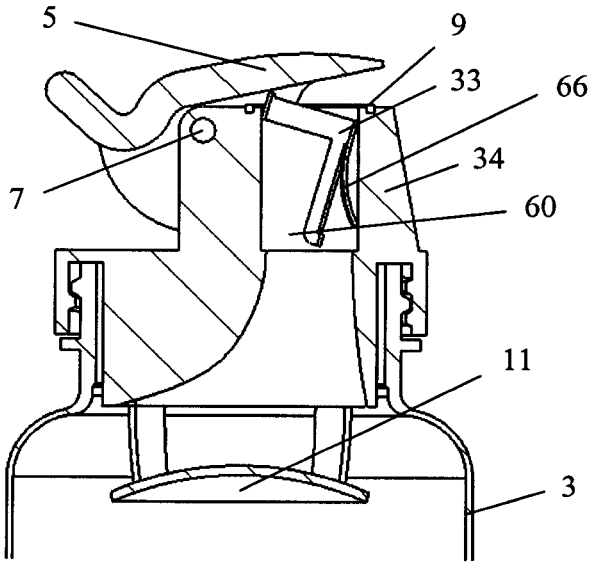
FIG. 39 is a side sectional view of the alternate design of FIG. 38 with the lid open and rotating gate closed.

Referring to FIG. 13, the enlarged section view shows the container 3 filled with pills 12 tipped upside down. This would be the case when the user is just beginning to open the lid 5 and the pill 12 begins to pass downward through the channel 60 of the cap 10. The protrusion 62 on the underside of the lid 5 is shown allowing the gate to close, thereby blocking the second pill 12 in the channel 60 from following the first pill 12 passing through the exit from the channel 60 as shown in FIGS. 14 and 15. One skilled in the art will recognize that the protrusion 62 need not be integral with the lid and can be an upward extension from the gate, such as shown in FIG. 39, or otherwise situated so that movement of the lid causes movement of the gate.

Figure 16:
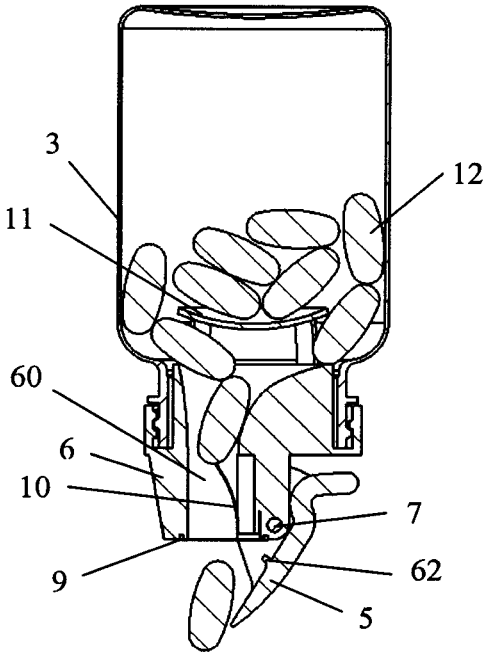
FIG. 16 is a side sectional view of the cap and container of FIG. 12 with the lid open dispensing a single pill.

FIG. 16 shows a section view of the container 3 tipped upside down while dispensing a single pill 12. The lid 5 is fully open and a single pill 12 is shown being dispensed from the bottle. The next pill 12 and all other pills 12 are held in the channel 60 of the cap 6 by the closed gate 10.

Figure 17:
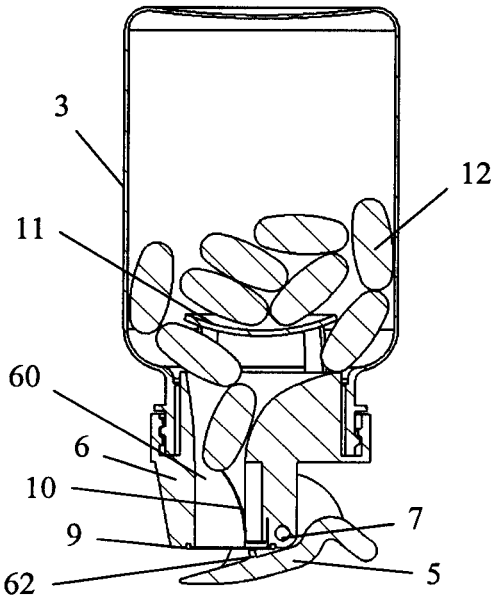
FIG. 17 is a side sectional view of the cap and container as shown in FIG. 16 after dispensing a pill.

FIG. 17 shows a sectional view of the container 3 tipped upside down with the lid 5 starting to close. A pill 12 has just been dispensed and the lid 5 is being closed for storage or to reset the cycle and dispense another pill 12. The lid 5 is partially closed but not contacting the gate so all other pills 12 are still being held in the channel 60 of the cap 6 by the closed gate 10.

Figure 18:
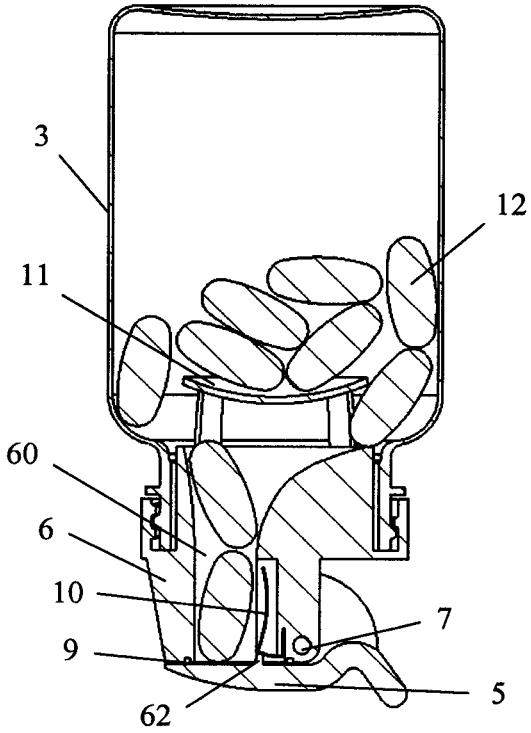
FIG. 18 is a side sectional view of the cap and container as shown in FIG. 16 with the lid closed after dispensing a pill.

FIG. 18 is a sectional view of the container 3 tipped upside down with the lid 5 closed in the last step of dispensing a pill 12. The lid 5 is fully closed and contacting the open gate 10. The pills 12 previously held in place by the closed gate 10 are allowed to travel down the channel 60 of the cap 6 to be stopped by the lid 5 and are ready to be dispensed if activated again by the user. If the container 3 is turned upright, all the pills can fall back to a similar position as shown in FIG. 10.

Figure 19:
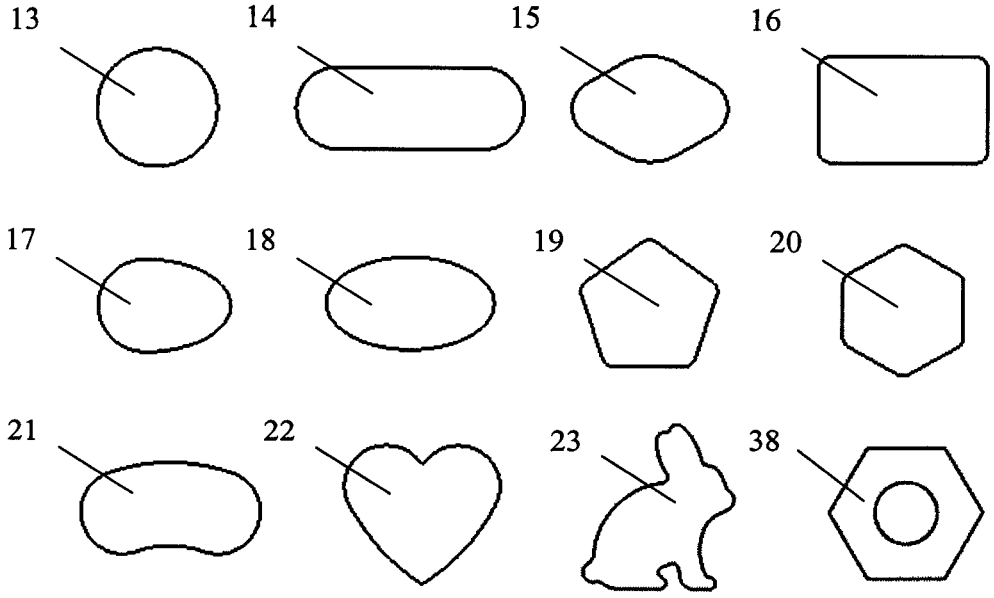
FIG. 19 is a front view of alternative pill, candy or tablet shapes.
Figure 28:
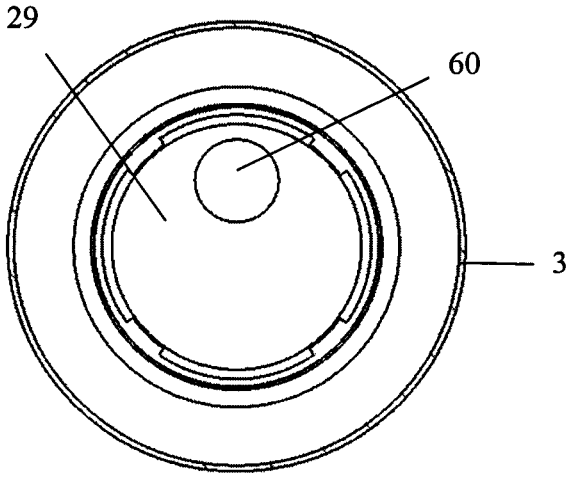
FIG. 28 is a bottom view of an alternate embodiment of the funnel portion of the cap inlet with a round channel.
Figure 29:
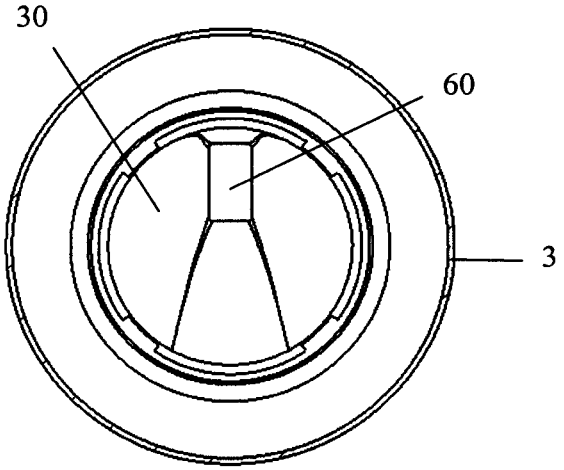
FIG. 29 is a bottom view of an alternate embodiment of the funnel portion of the cap inlet with a rectangular channel.

A cap and container assembly incorporating features of the invention can be designed to accommodate nearly any shape of pill 12. FIG. 19 shows some examples of common pill shapes as well as common candy shapes. Round, cylindrical, and elliptical shaped pills 13, 14, 18 can easily be accommodated with a round channel 60 in the cap 2 as shown in FIG. 28. Flatter pills such as diamond 15, rectangular 16, five sided 19, six sided 20 or other multisided pills 12 can easily be accommodated with a rectangular channel 60 in the cap as shown in FIG. 29. To determine which channel 60 shape will work best for a particular pill 12 shape, consideration of the cross sectional shape of the pill is taken by sectioning the pill perpendicular to the long axis. If the cross sectional shape is narrow in one direction and wide in the other, a rectangular channel 60 will work best. If the cross sectional shape is nearly round, a round channel 60 will work best. For candy shapes in FIG. 19 such as bean 21, heart 22 and a character shape 23 the same analysis can be done to determine the appropriate channel 60 shape. Similarly, the design can be extended to nuts, bolts or any other small item requiring dispensing by simple modifications incorporating, based on the teachings herein, the same essential functional components.

FIGS. 20, 21, 22 and 23 show several alternative embodiments 24, 25, 26, 27 of the pill deflector. One skilled in the art will recognize that numerous other alternative structures can be used. The purpose of the various different pill deflectors is to slow down and separate the pills as the bottle is tipped upside down for dispensing. The addition of the deflector greatly increases the reliability of the dispenser by slowing down the fast falling large quantity of pills, thereby allowing only a few pills 12 to enter the funnel portion of the channel 60 of the cap 6 before the rest become jammed in the container.

Figure 20:
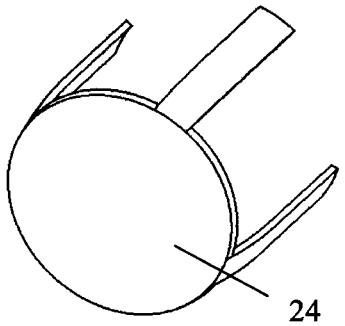
FIG. 20 is a perspective view of a first alternate embodiment of the pill deflector with a solid base.
Figure 21:
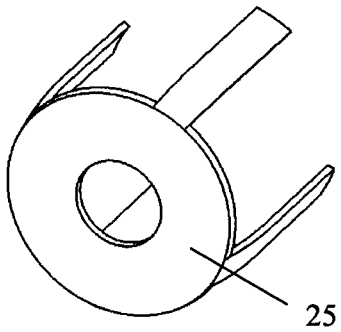
FIG. 21 is a perspective view of a second alternate embodiment of the pill deflector with a perforated base.
Figure 22:
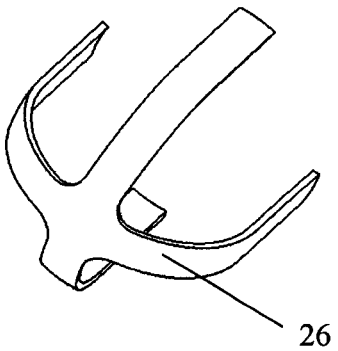
FIG. 22 is a perspective view of a third alternate embodiment of the pill deflector with a beam-like base.
Figure 23:
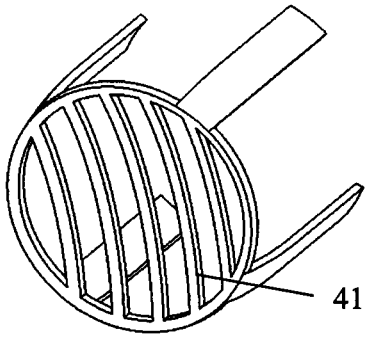
FIG. 23 is a perspective view of a fourth alternate embodiment of the pill deflector with a ribbed or slotted base.
Figure 24:
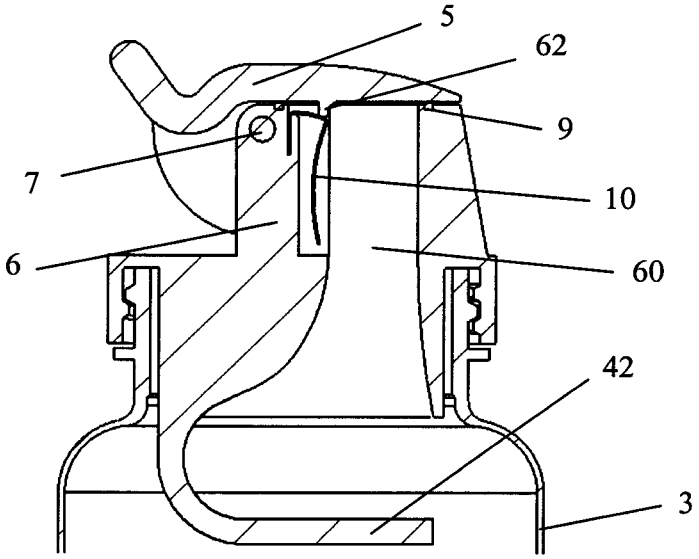
FIG. 24 is a side sectional view of an alternate embodiment of the pill deflector that is an extension of the cap or funnel.

FIG. 20 shows a simple round pill deflector with legs attached to displace it from the funnel portion of the channel 60. The legs are long enough to create a gap large enough between the funnel cap 6 and the face of the pill deflector 24 to allow pills to pass around the edges. FIG. 21 shows a design similar to FIG. 20 but is perforated with one or more holes in the face of the pill deflector 25. This design can be useful when the diameter of the cap is similar in size to the diameter of container 3 and more pill passage ways are needed. FIG. 22 is a simple pill deflector 26 consisting or ribbons, beams or rods. A similar design could be comprised of wires or a mesh. All of these designs could either be flat, concave or convex in shape and are not required to be round. In further detail, FIG. 23 is a version of FIG. 22 where the pill deflector 41 is shown with ribs or slots that can slow the pills as well as orient them for alignment into the funnel and channel 60. All of these designs can be attached to or made part of the cap 42 embodiment as shown in FIG. 24. The specific implementation of the pill deflector depends on the size and shape of the pill 12 as well as the neck size of the cap in relationship to the size of the container 3.

Figure 25:
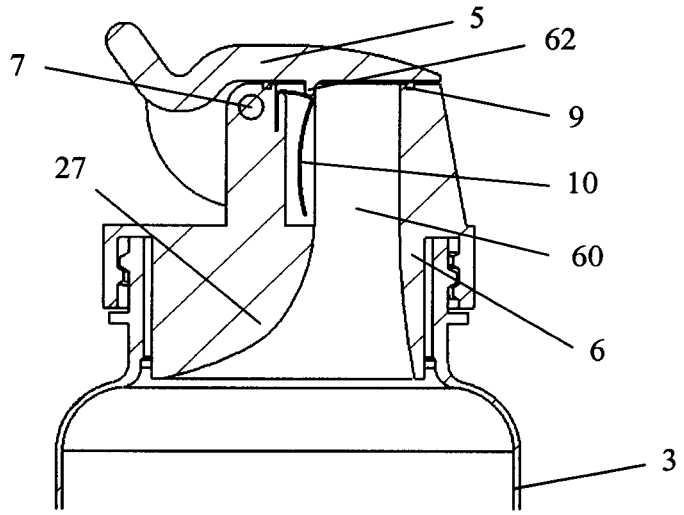
FIG. 25 is a side sectional view of an alternate embodiment of the funnel portion of the cap inlet with a trumpet-like shape.
Figure 26:
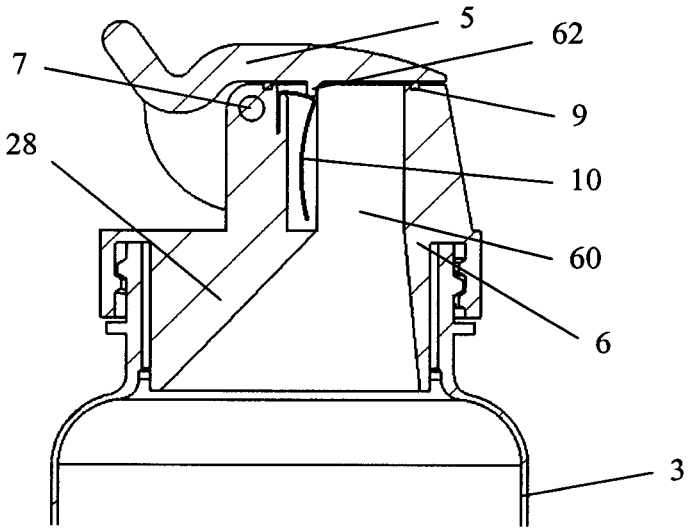
FIG. 26 is a side sectional view of an alternate embodiment of the funnel portion of the cap inlet with a conical shape.
Figure 27:
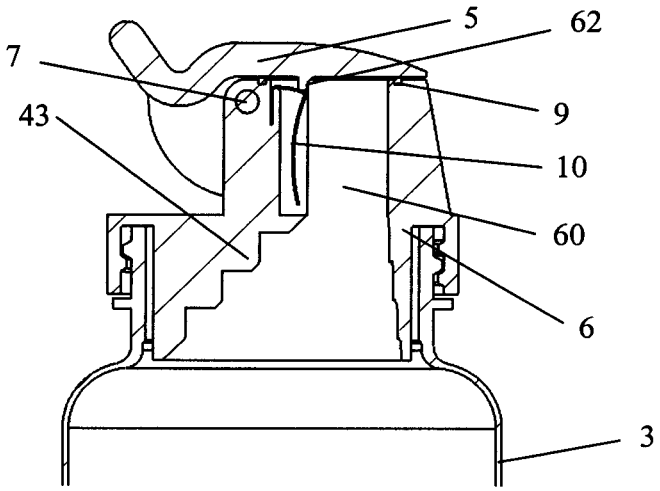
FIG. 27 is a side sectional view of an alternate embodiment of the funnel portion of the cap inlet with a stepped or scallop shape.

The inlet of the cap contains a funnel that guides and aligns pills into the channel 60 of the cap. FIGS. 25, 26 and 27 show different embodiments of the funnel portion of the cap. The inclusion of the funnel increases the reliability of the dispenser by first guiding the pills 12 to the channel 60 and secondly aligning them in such a way that they are able to fit into the narrowed channel 60. Non-spherical pills should only fit into the funnel when their long axis is parallel to the channel 60. FIG. 25 is an example of a trumpet or rounded funnel shape 27. FIG. 26 is an example of a conical or straight funnel shape 28. FIG. 27 is an example of a step or scalloped funnel shape 43. The funnel can be a variety of common shapes or even more complex shapes like wavy funnels or vortex funnels. The funnel shape is optimized to the size and shape of the pill 12. More complex pill shapes may require the funnel to rotate and align the pill to the channel 60 of the cap. For example, FIG. 29 is a square channel 60 which would accommodate pills that are square or disk shaped such as shown in FIG. 19. When the pill becomes more spherical, the specific shape of the funnel becomes less important as alignment is not required.

Figure 30:
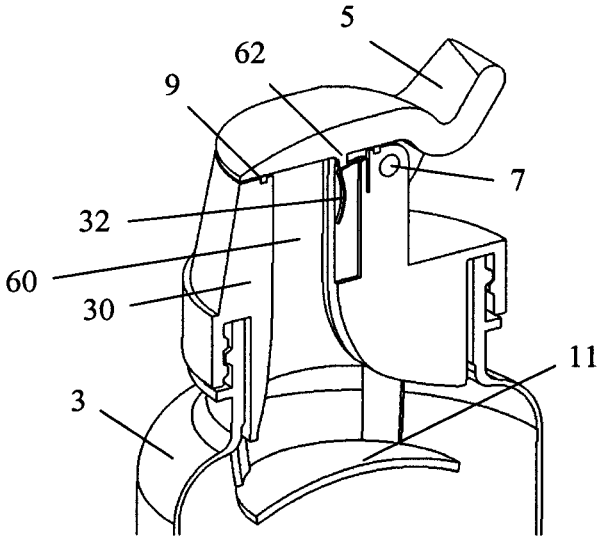
FIG. 30 is a perspective cutaway view of the alternate embodiment of the cap as shown in FIG. 25 with the lid closed and gate open.
Figure 31:
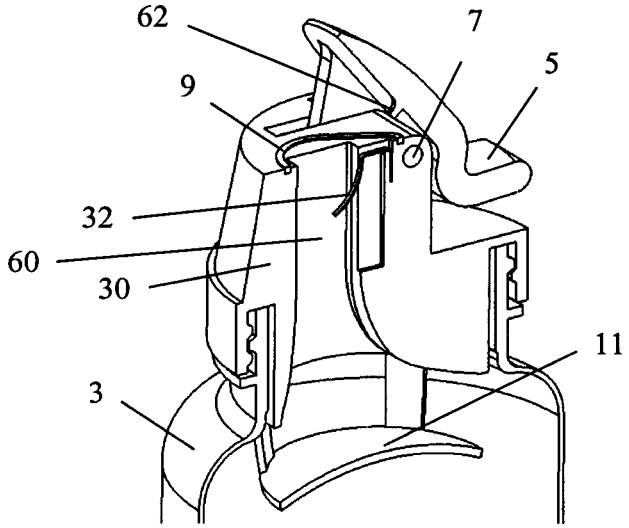
FIG. 31 is a perspective cutaway view of an alternate embodiment of the cap shown in FIG. 25 with the lid open and gate closed.

FIGS. 30 and 31 show alternate embodiments of the invention where the funnel cap 30 has been replaced with a rectangular channel 60 to accommodate a disk shaped pill. The gate 32 has also been adjusted in size to accommodate the shorter disk shaped pill. FIG. 30 shows the protrusion 62 on the underside of the lid 5 contacting the gate 32 and opening the gate which leaves the channel 60 of the cap 30 clear. FIG. 31 shows the lid 5 open. The protrusion 62 on the underside of the lid 5 is not contacting the gate 10 and therefore the gate 10 is closed so it blocks the channel 60.

Figure 32:
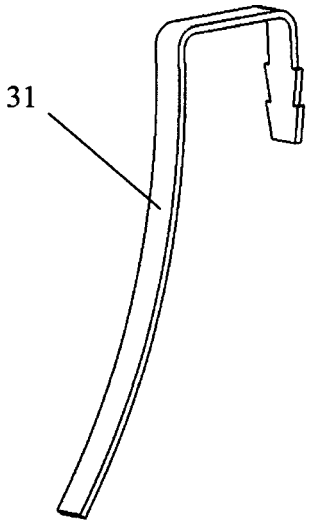
FIG. 32 is a perspective view of an alternate embodiment of a cantilever gate for use with a long pill.
Figure 33:
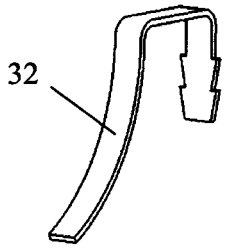
FIG. 33 is a perspective view of an alternate embodiment of a cantilever gate for use with a short pill.
Figure 34:
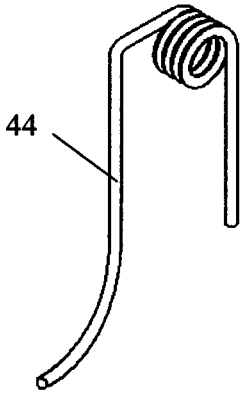
FIG. 34 is a perspective view of an alternate embodiment of a torsion spring gate.

The gate described in the present invention can be adjusted in length and width to accommodate nearly all pill shapes. FIGS. 32 and 33 show different gate embodiments. FIG. 32 shows a first cantilever gate 31 for a cylindrical shaped or long pill. FIG. 33 shows a second cantilever gate 32 for a disk shaped or short pill. In both, the barb shaped portion on the back of the gate is designed to be press fit into a slot (not shown) in the funnel cap 6. FIG. 34 shows a torsion spring gate 44 that is actuated in the same manner as the cantilever gates 31, 32. Alternatively, the attachment mechanism of the gate to the cap may be any means that couples the two to each other such as an adhesive or heat weld.

Figure 36:
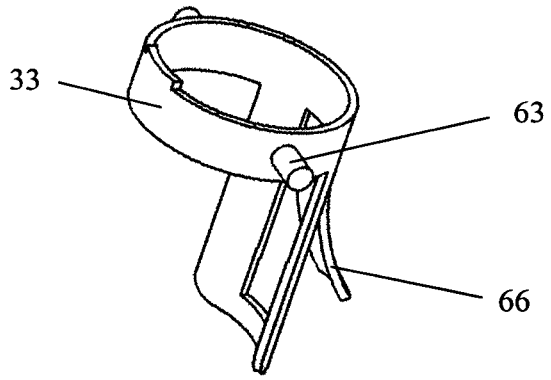
FIG. 36 is a perspective view of an alternate design of the rotating gate in a closed gate orientation.
Figure 37:
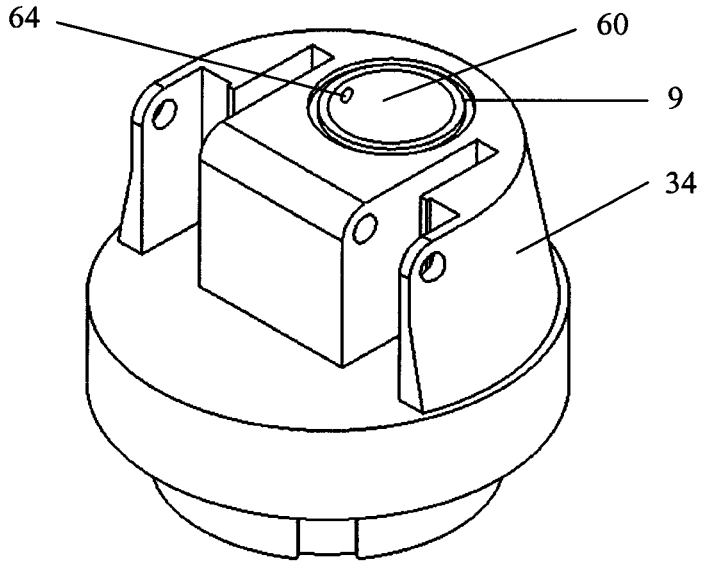
FIG. 37 is a perspective view of an alternate design of the cap for use with the rotating gate shown in FIGS. 35 and 36.

The deflection gate described above is offset to the channel 60 of the cap. An alternative gate 33 that resides entirely within the channel 60 of the cap is shown in its open state in FIG. 35 and in its closed state in FIG. 36. As previously set forth, the gate 33 is activated by the lid such that when the lid is closed the gate is open and when the lid is open the gate is closed. In this embodiment the gate is coaxial to the channel 60 when the lid is closed and then rotates when the lid is open. The rotating gate 33 can be seen to have hinge pin protrusions 63 on the sides which engages with holes 64 in the channel 60 of the cap 34, allowing limited rotation about them. FIG. 37 is a bottom perspective view of an alternate embodiment of the funnel cap 34 showing the holes 64 for receiving the hinge pin protrusions 63 on the alternative rotating gate 33. This alternate embodiment of the gate 33 may be made from a plastic or formed sheet metal. Another alternative is to create this feature from a wire.

Figure 35:
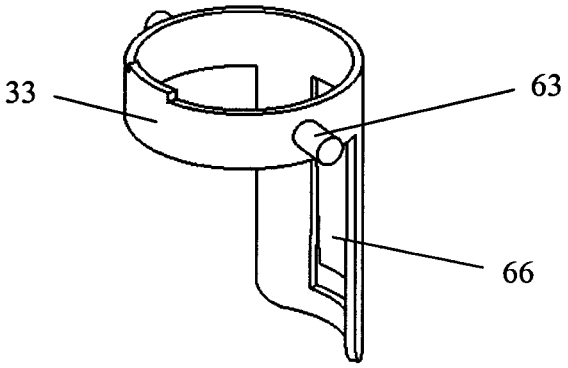
FIG. 35 is a perspective view of an alternate design of a rotating gate in an open gate orientation.
Figure 38:
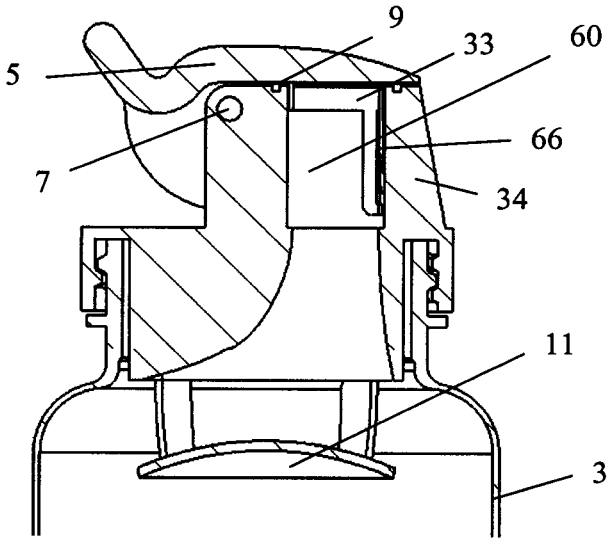
FIG. 38 is a side sectional view of an alternate design of a cap incorporating features of the invention with the lid closed and rotating gate open.

FIG. 38 shows an alternative rotating gate 33 contained within the funnel cap 34 with the lid 5 closed and the gate 33 open. The cantilever spring 66 on the right of the rotating gate 33, shown in FIGS. 35 and 36 is normally extended and the contact of the lid 5 with the gate 33 forces it to lay down coaxial to the channel 60. The gate 33 shown in FIG. 38 has its cantilever spring 66 compressed and coaxial to the lid 5. Referring now to FIG. 39, the lid 5 is shown open with the alternative gate 33 pivoted from the reaction force of the cantilever spring 66, closing and blocking the channel 60 of the cap 34.

Figure 40:
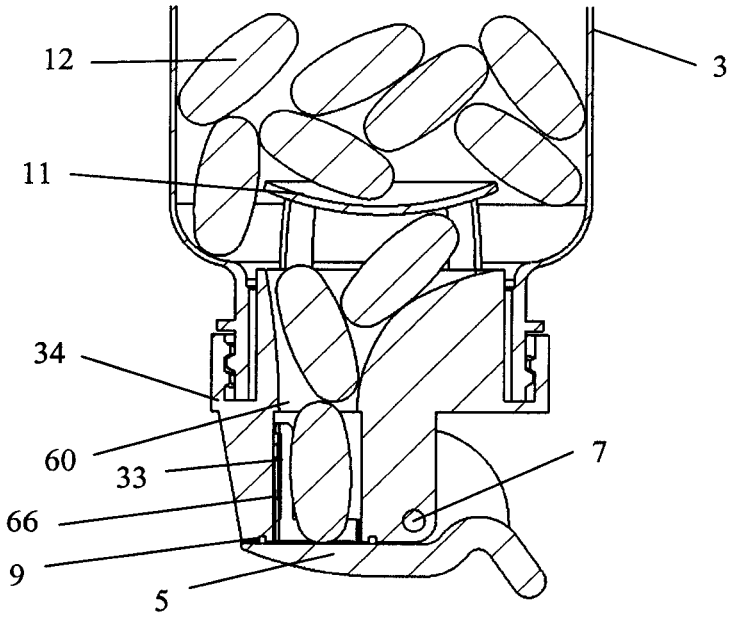
FIG. 40 is a side sectional view of the alternate design of FIG. 38 with pills inside of the container and the lid closed in an upside down orientation.

FIG. 40 shows a cross sectional view of an alternate embodiment with the container 3 filled with cylindrically shaped pills 12 and tipped upside down, representing a use of the pill bottle that has been picked up by a user who is about to dispense a pill 12. The benefit of the pill deflector 11 can be seen in that it allows only a few pills to pass into the funnel and channel 60 of the cap 34. If the pill deflector 11 is not present, the pills can jam in the funnel portion and become locked in place, requiring further agitation of the container 3 or other movements for one or more pills 12 to fall into the channel 60 of the cap. The closed lid 5 forces the rotating gate 33 to be coaxial to the channel 60 allowing the pills 12 to contact the underside of the lid 5. The actions of the parts remain the same as previously described with the with the exception of the functioning of the rotating gate 33.

Figure 41:
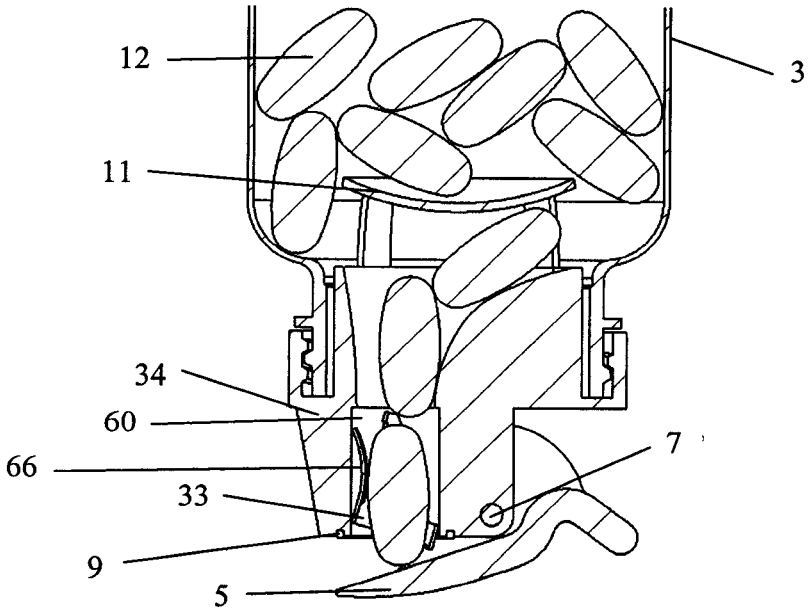
FIG. 41 is a side sectional view of the alternate design of FIG. 38 with pills inside of the container and the lid starting to open.

FIG. 41 shows a container 3 tipped upside down containing pills 12. This is the container orientation when the user is just beginning to open the lid 5 and the pill 12 begins to descend from the channel 60 of the cap 10. The lid 5 allows the gate to rotate and close, thereby blocking the second pill 12 in the channel 60 and preventing it from following the first pill 12.

Figure 42:
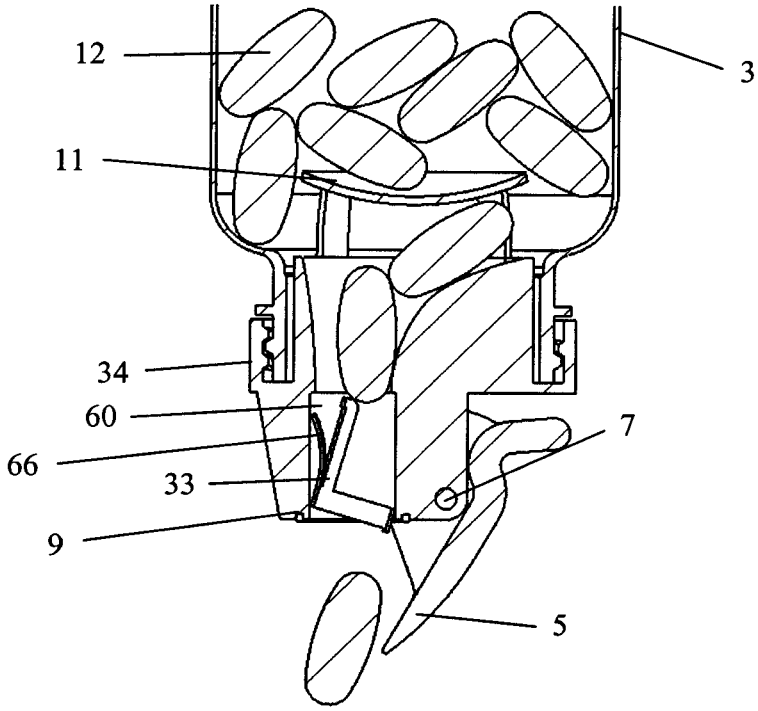
FIG. 42 is a side sectional view of the alternate design of FIG. 38 with pills inside of the container and the lid open dispensing a single pill.

FIG. 42 is a cross section view of the container 3 tipped upside down while dispensing a single pill 12. The lid 5 is fully open and a single pill 12 is shown being dispensed from the container 3. The next pill 12 and all other pills 12 are held in the channel 60 of the cap 34 by the closed gate 33.

Figure 43:
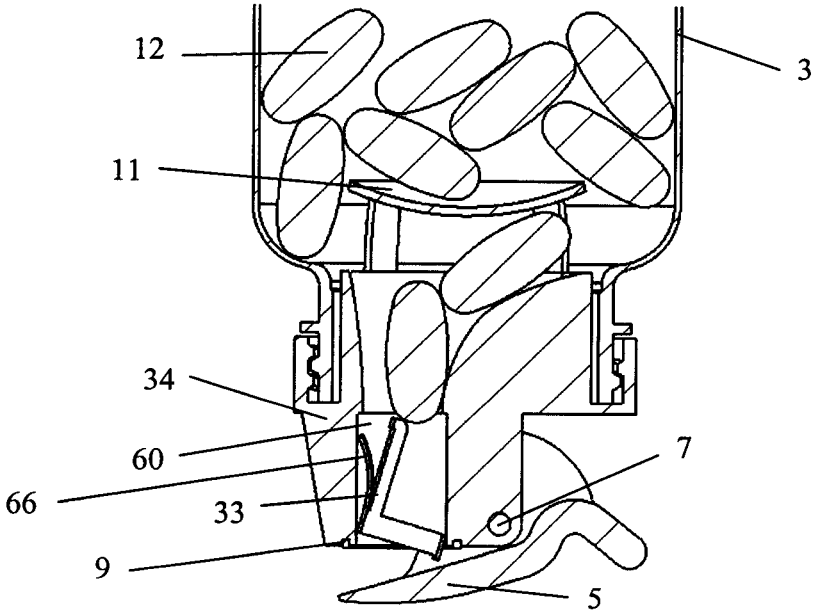
FIG. 43 is a side sectional view of the alternate design of FIG. 38 with pills inside of the container and the lid starting to close.

FIG. 43 is a cross sectional view of the container 3 tipped upside down with the lid 5 starting to close. A pill 12 has just been dispensed and the lid 5 is being closed to put the bottle away or to reset the cycle and dispense another pill 12. The lid 5 is partially closed but not contacting the gate 33 so all the other pills 12 are still being held in the channel 60 of the cap 34 by the closed gate 33.

Figure 44:
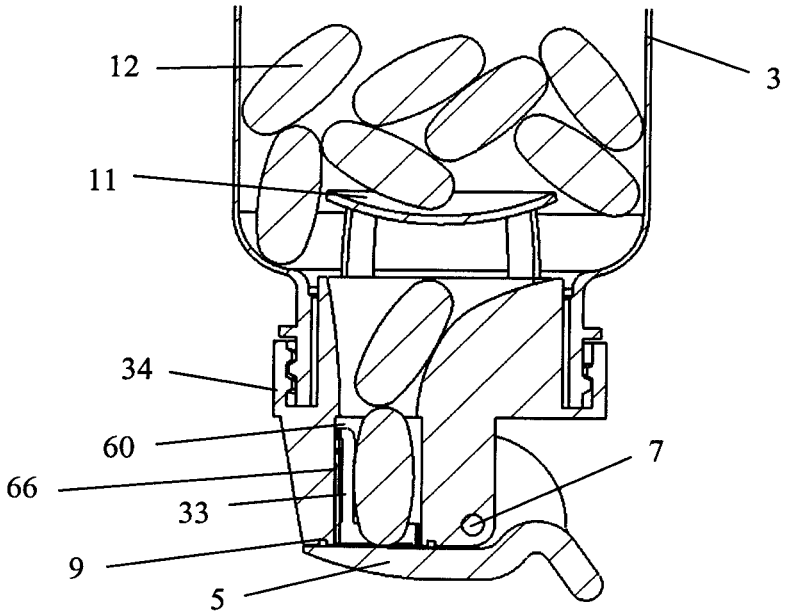
FIG. 44 is a side sectional view of the alternate design of FIG. 38 with pills inside of the container and the lid closed.

FIG. 44 shows a cross sectional view of the container 3 tipped upside down in the last step of the single pill dispensing procedure with the lid 5 closed. The lid 5 is fully closed and contacting the open gate 33. A pill 12 previously held in place by the closed gate 33 is allowed to travel down the channel 60 of the cap 34 where it is stopped by the lid 5, now ready to be dispensed if activated again by the user. If the container 3 is turned upright, all the pills can fall back to the bottom of the container.

Figure 45:
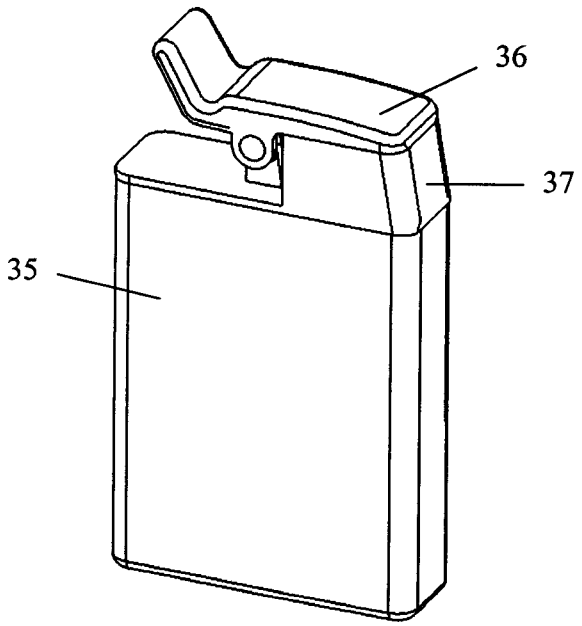
FIG. 45 is a perspective view of a further embodiment of a rectangular container with the lid closed.
Figure 46:
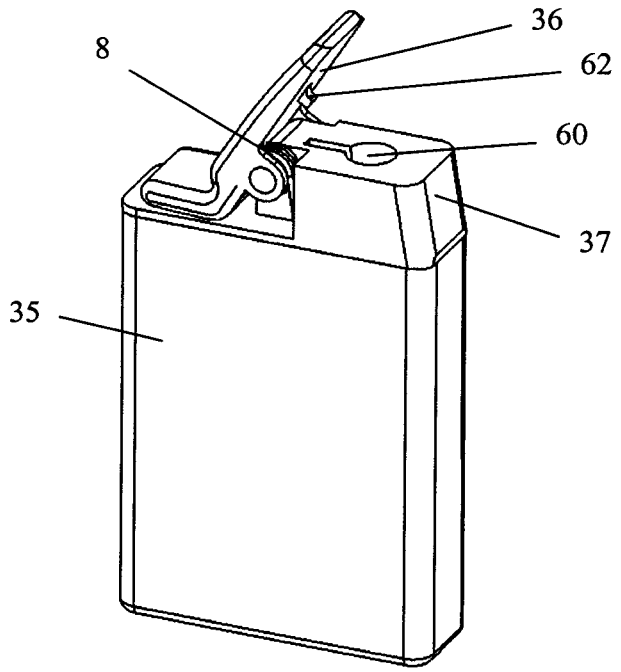
FIG. 46 is a perspective view of the rectangular container embodiment of FIG. 45 with the lid open.

FIGS. 45 and 46 show an alternate embodiment with a rectangular container 35 and associated components incorporating features of the invention. The non-round small rectangular container 35 is shown in FIG. 45 with the lid closed and in FIG. 46 with the lid open.

An exploded view of the alternate embodiment of FIGS. 45 and 46 is shown in FIG. 47. In contrast to the previous designs, the number of parts in this embodiment has been minimized. A hinge pin is not used, as it is replaced by features incorporated in the funnel cap 37. The lid 36 in this embodiment is preferably made from plastic such that it can be easily connected to the hinge features on the funnel cap 37. As shown, the rectangular container 35 is intended for dispensing a small sized pill. Accordingly, the gate 32 is shortened and the torsion spring 8 is smaller. The pill deflector is not used in this embodiment to demonstrate that in some cases, such as for a small container or spherical pills, the jamming issues that require the pill deflector for reliable dispensing may not exist or may be minimal.

Figure 48:
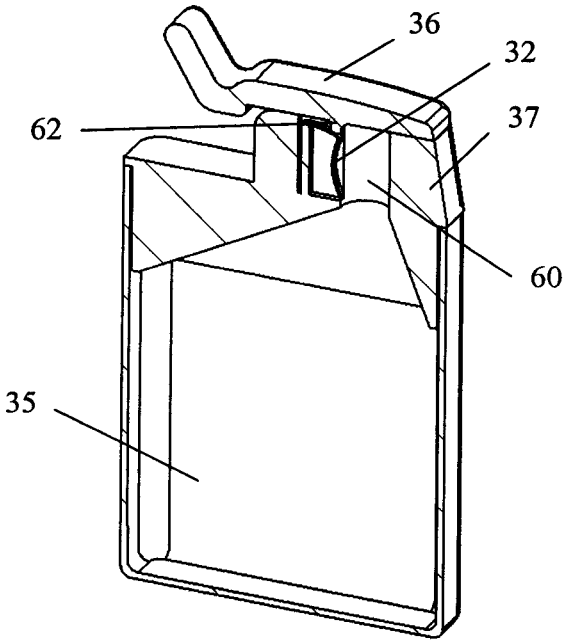
FIG. 48 is side sectional perspective view of the alternate embodiment of FIG. 46 with the lid closed.
Figure 49:
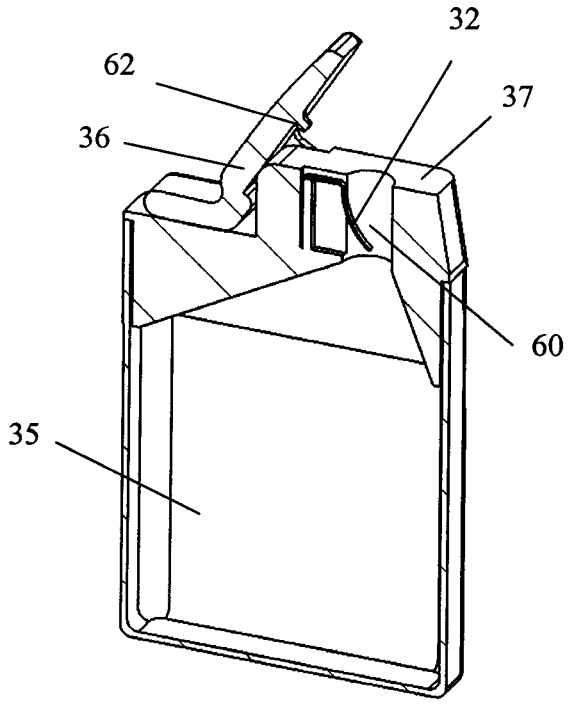
FIG. 49 is side sectional perspective view of the alternate embodiment of FIG. 46 with the lid open.

FIG. 48 is a cross sectional view of the alternate embodiment shown in FIG. 45. Similar to previous images, the lid 36 can be seen closed, which opens the gate 32. In FIG. 49 the lid 36 is shown open, which closes the gate 32.

Figure 50:
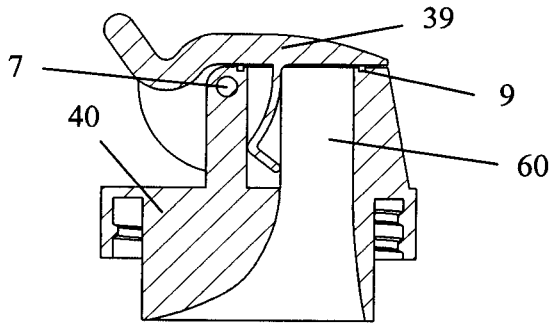
FIG. 50 is a side sectional view of an alternate embodiment showing the lid and gate as a single integral part with the lid closed.
Figure 51:
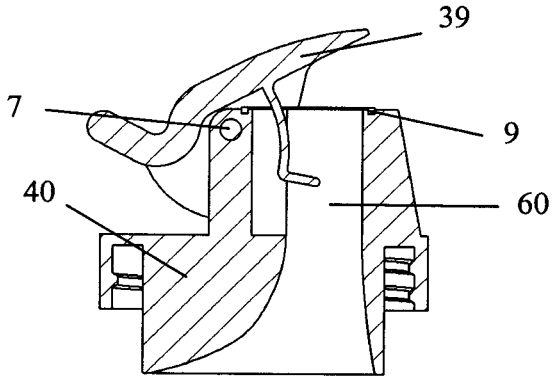
FIG. 51 is a side sectional view of the alternate embodiment of FIG. 50, the lid shown partially open.
Figure 52:
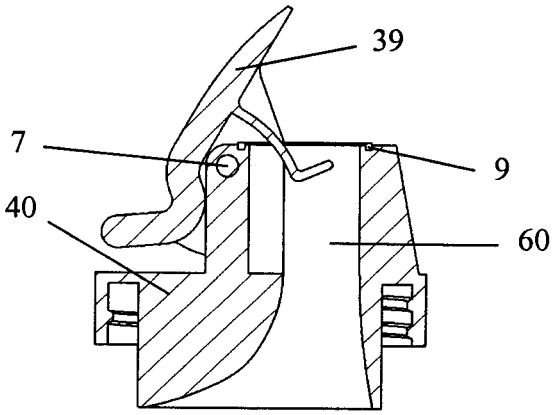
FIG. 52 is a side sectional view of the alternate embodiment of FIG. 50, the lid shown open.
Figure 53:
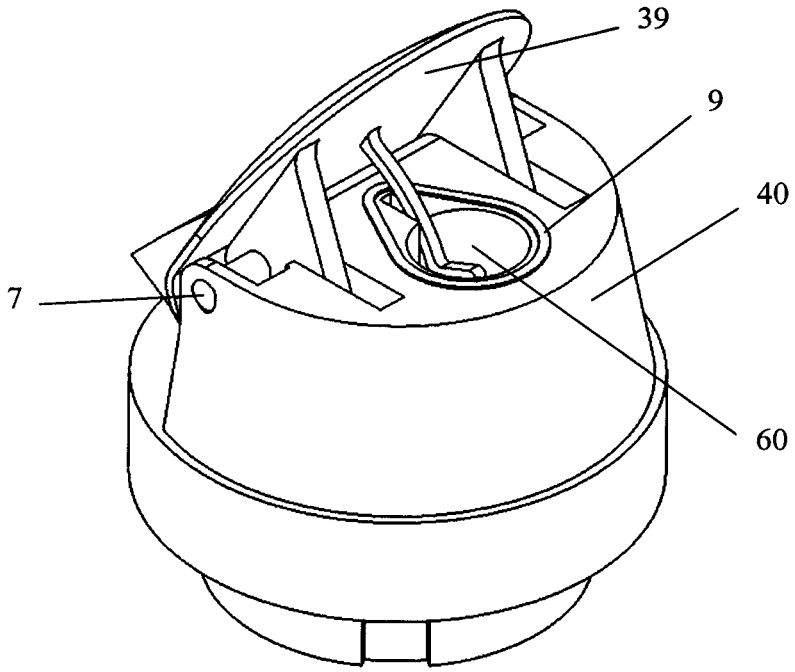
FIG. 53 is a perspective view of the alternate embodiment of FIGS. 50-52 with the lid shown open.

FIG. 50 shows a section view of an alternate embodiment of a lid 39 with the gate 10 integral therewith. FIGS. 51 and 52 show the subsequent section views of the lid 39 opening and the attached gate moving out of the recess in the cap 40 and into the channel 60. FIG. 53 shows a perspective view of the embodiment shown in FIG. 52 where the lid 39 is completely open and the gate 10 attached to it in its closed position, blocking the channel 60 of the cap 40. This embodiment includes a seal 9 substantially the same as the seal in the other embodiments.

Figure 54:
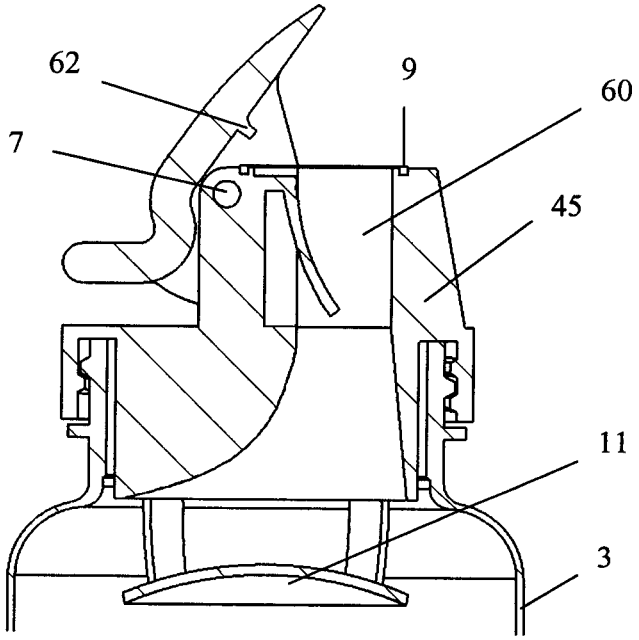
FIG. 54 is a side sectional view of an alternate embodiment showing the gate integral with the cap in its open configuration.
Figure 55:
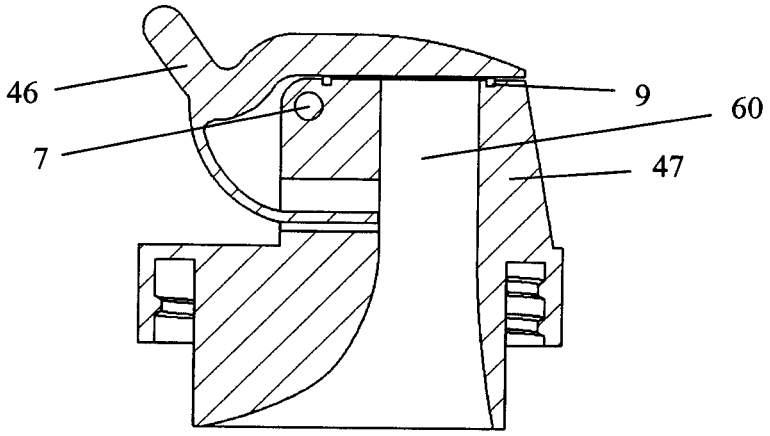
FIG. 55 is a side sectional view of another alternate embodiment of the lid and gate combined into one part, with the lid shown closed.
Figure 56:
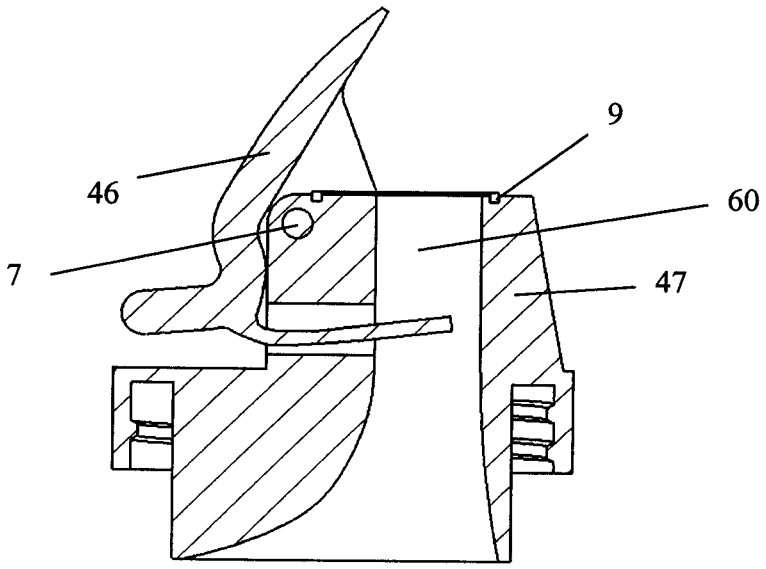
FIG. 56 is a side sectional view of the alternate embodiment of FIG. 55 with the lid shown open.
Figure 57:
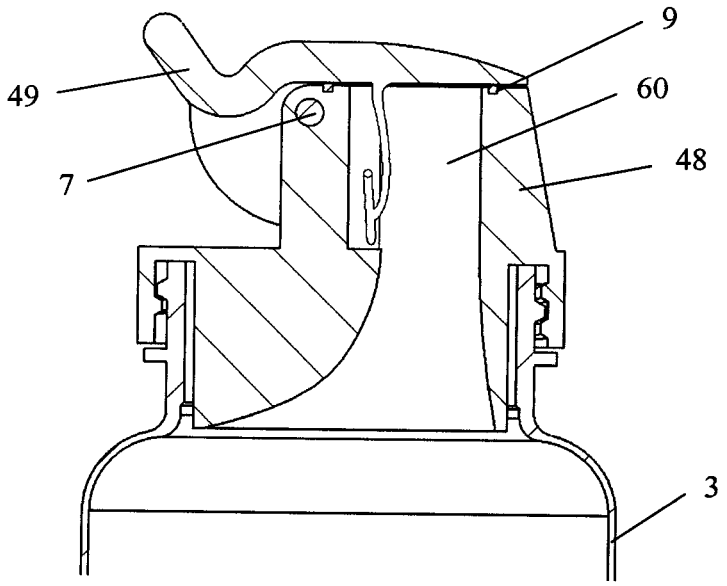
FIG. 57 is a side sectional view of another alternate embodiment of the lid and gate, the gate being a flexible, the lid shown closed.
Figure 58:
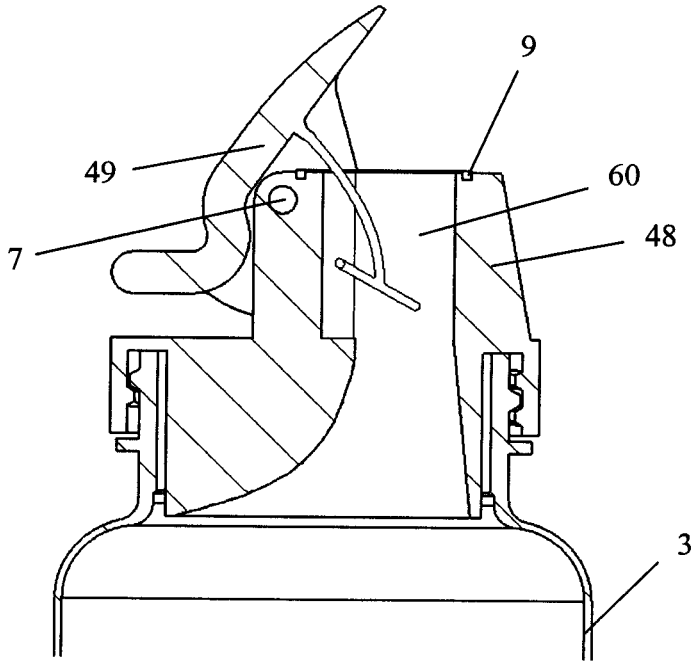
FIG. 58 is a side sectional view of the alternate embodiment of FIG. 57, the lid shown open.

FIG. 54 shows a section view of an alternate embodiment of the cap 45 where the gate 10 is formed as a single flexible part integral with the cap 45. Other embodiments shown in FIGS. 55 and 56 show a lid 46 and cap 47 with a further alternative arrangement of the gate 10 and lid 46 as a single part such that the gate closes as the lid opens by rotating with it. The gate 10 is similarly opened when the lid 46 closes as the two rotate together. FIGS. 57 and 58 show a section view of a still further alternate embodiment of the cap 48 and lid 49 where the lid 49 has been combined with the gate 10 as a flexible mechanism with living hinges. This embodiment operates like a four bar mechanism with the two pivot points being the pivot point of the lid 49 to the cap 48 and the gate to the cap.

Figure 59:
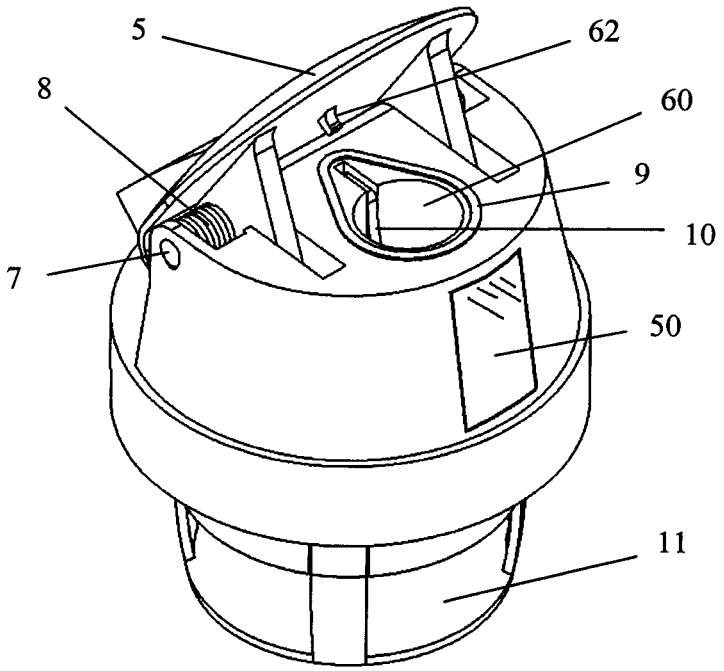
FIG. 59 is a perspective view of another alternate embodiment of the cap including a clear window in front of the pill channel.

FIG. 59 shows a clear section or window 50 in the cap (which can be the cap of any of the prior described embodiments) to allow visualization of the pill in the channel 60 prior to dispensing. The cap can, as an alternative, also be constructed of a translucent or transparent material to facilitate visualization as well.

Figure 60:
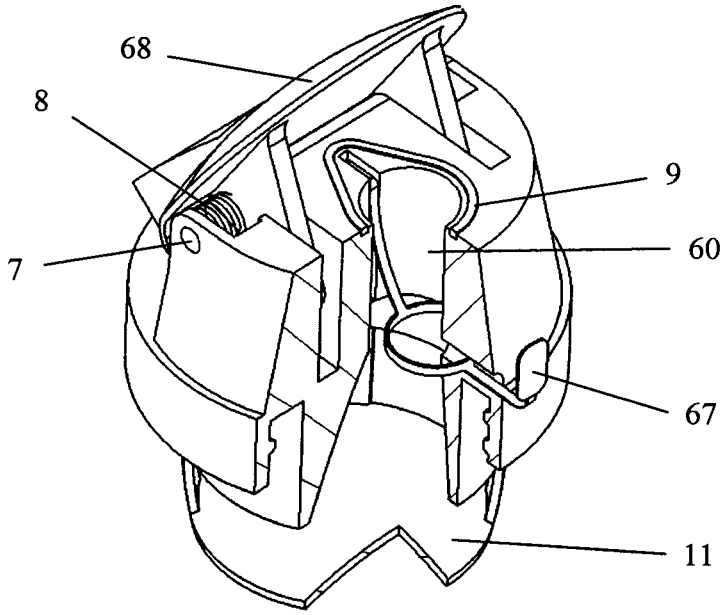
FIGS. 60 and 61 show a further embodiment utilizing a push button.
Figure 61:
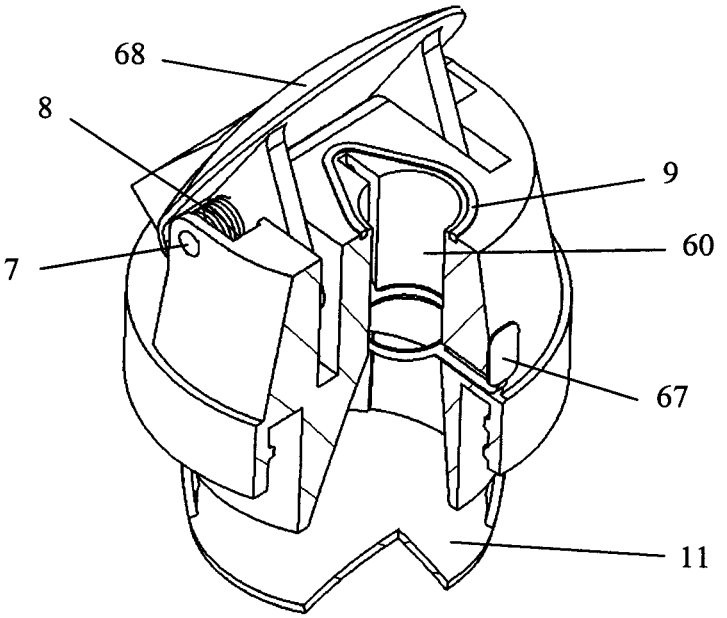

In preferred embodiments the movement of the lid 5 between open and closed orientation causes the gate 10 to move from a position blocking the channel 60 to a position unblocking the channel, one skilled in the art, based on the teachings herein will recognize that such interconnected functioning is not necessary. FIGS. 60 and 61 show and alternate embodiment in which the lid 68 and gate 10 operate separately. The gate 10 includes an extension 67 that extends through the side of the cap 2 such that depressing the extension 67 moves the gate from its blocking configuration, as shown in FIG. 60, to its open position as shown in FIG. 61. Upon releasing the extension 67 the gate returns to it normally closed (blocking) position. This embodiment does not require opening and closing the lid 68 to dispense a pill. With the lid 68 in its open position the extension can be depressed multiple times to dispense multiple pills such that 1 pill is dispensed each time the extension 67 is depressed and released.

Figure 62:
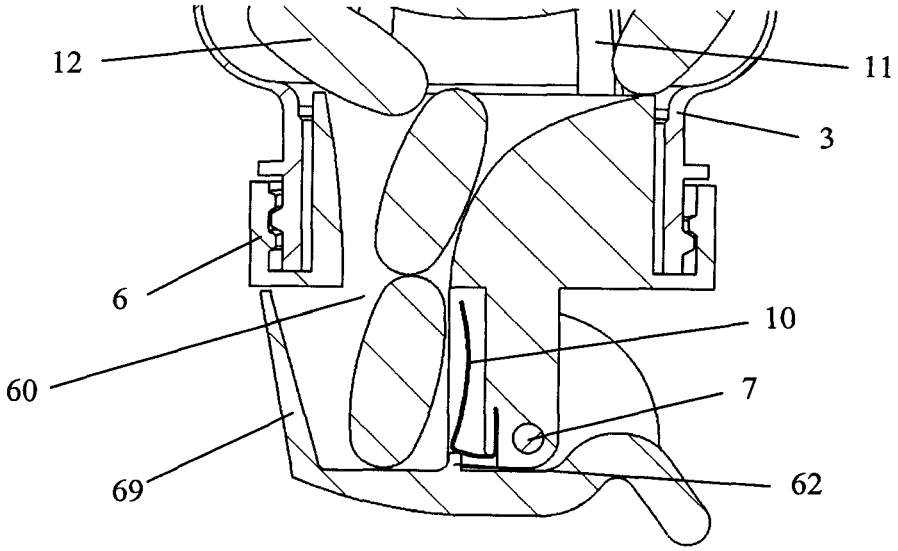
FIG. 62 shows an embodiment of the cap with a side exit port.

FIG. 62 shows a still further version of a cap incorporating features of the invention. In the prior illustrated embodiments the exit from the channel 60 is in the top surface of the cap. However, as shown in FIG. 62 the exit from the channel 60 can be through a side wall of the cap 2.

Figure 63:
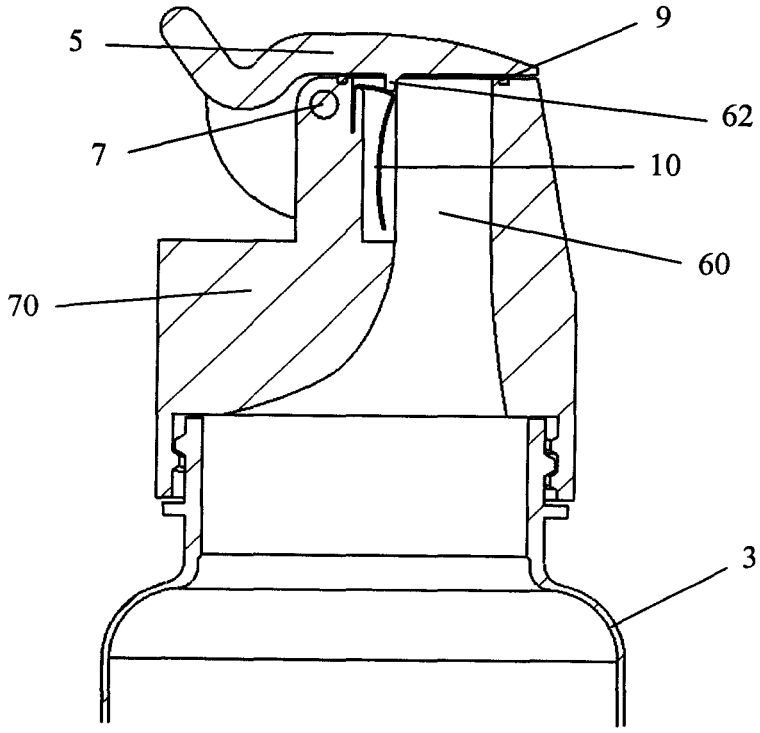
FIG. 63 is a further embodiment showing all of the cap structure positioned so as to be above a threaded connection to a container.

FIG. 63 shows another embodiment incorporating a funnel 70 such that when the cap is attached to the container, FIG. 63 showing a threaded engagement of the cap to the container, the internal cap components are all above the container opening. The prior embodiments showed at least some of the cap components extending into the container once assembled for use.

The dispensing cap disclosed herein includes some or all of the following features or components:

1. An ergonomic assembly for dispensing pills, candy, tablets, or parts with a spring loaded auto closing lid that can be operated easily with one hand without much force or effort.
2. A cover which includes a funnel for aligning and guiding the pills, candy, tablets, or parts into a channel where they line up single file along their long axis for reliable dispensing.
3. A deflector at the funnel inlet to regulate the rate at which items reach the funnel portion and to prevent the items from jamming in the funnel portion. If a gate is used for single unit dispensing, the deflector also reduces the weight of the items against the gate which reduces the force requirements of the gate.
4. A gate extending or blocking the continuous flow of items after the first is dispensed. The gate also retracts or clears the channel when the lid is closed such that the next items can line up. The gate is a feature that meters the items for reliable and controlled single unit dispensing. The gate can either be part of the lid or a separate part.
5. An optional air-tight seal between the lid and the cap to protect the bottle contents from moisture or contaminates.
6. A lid that hinges or slides on the cap with an integrated or separate spring to return the lid to normally closed position.
7. A cap that houses a funnel and attaches to a container.
8. The dispenser can include available child resistant features which prevent dispensing of the contents by children.
9. A cap can be adjusted to provide universal adaptability for fitting on containers with different mouth openings; clamping or securing mechanism can be incorporated which mate the cap to the container.
10. A cap that is translucent or transparent or contains a clear window to allow pill visualization prior to dispensing.
11. Reduced part count embodiments that incorporate multiple component features into a single component, such as
    a) a lid and gate that are connected or function via a living hinge,
    b) a cap that contains a funnel and deflector,
    c) elimination of hinge pins and springs and replacing them with pivoting snap fits and molded springs or elimination of the spring completely so that the gate, for example, has a weighted end and then moves in response to gravity.
12. A dispensing cap for safe dispensing of hazardous pills or tablets that people should not handle.
13. A dispensing cap design without parts protruding into the neck of the bottle or container so that the dispensing cap and bottle can be assembled by traditional induction sealing methods which seal the cap to the bottle so it can be shipped assembled ready for customer use.

14. A container and cap design where the opening of the lid activates the constriction of the pill channel, thereby limiting the number of pills that exit the bottle with each actuation for single unit dispensing.

While the embodiments shown and described herein have various different features they all have some features in common. In particular they all show a cap for placement on the open end of a container and they are all configured for dispensing a single unit of items held in said container. However, one skilled in the art, based on the teachings herein will recognize that changes to the internal spacing with in the cap, for example the length of the channel 60 and the size and positioning of the gate can be made to dispense a predetermined number of items per single activation, for example, two pills at a time in place of a single pill. The caps have an upper surface, a lower end and a channel extending from the upper surface to the lower end, with the channel providing a passageway through the cap and sized to allow for items within the container to be transferred through an exit port in an upper portion of the cap to a space exterior to said cap. The exit port from the channel can be in the top surface of the cap or through a side wall thereof. A lid attached to the cap covers at least the channel exit in the upper surface or side of the cap. In a preferred embodiment the lid is moveable from a closed position to an open position so that when the lid is in its closed position items in the channel are prevented from being dispensed. When the lid is in its open position items are allowed to be dispensed, at least one item within the passageway passing through the exit port. If a gate is present it is a moveable gate positioned in the channel so that in a first orientation it at least partially blocks the passageway to prevent movement of the item there through and, in a second orientation it is moved to an unblocking position in the passageway to allow a single item, or a preset multiple of items, to pass there through when the container with cap is oriented for content delivery. In a preferred arrangement the lid and gate are configured so they operate in coordinated manner so that when the lid is opened the gate is positioned to allow delivery of a single item only and when the lid is closed a next item is allowed to move to a location from which it can be delivered upon a subsequent opening of the lid. However, in an alternate embodiment the lid and gate operate separately so that, with the lid is opened, the gate can be moved multiple times in and out of a channel obstructing position to deliver a single item each time it is caused to move as described.

Advantages of the embodiments described herein and variations thereof are that they can be simple replacements for the traditional cap on pill bottles or tablet and candy dispensers. They can be operated with one hand and provide a moisture barrier to the pills contained within while providing controlled dispensing. With the optional gate, they also provide a reliable method of single unit dispensing from a large container where in other designs, pill or item jamming would be an issue.

While the written description of the embodiments described herein incorporating features of the invention enable one of ordinary skill to make and use the devices described herein, those of ordinary skill will understand and appreciate the existence of variations, combinations, and equivalents of the specific embodiments, methods, components and examples herein. Further, one skilled in the art will recognize that description above, besides disclosing specific components and their interaction, likewise describes functional operating principles for the dispensing of single or controlled quantities of an item, such as a pill, and the components can be modified for the purposes of manufacturing, assembly or utilization while incorporating the principles of operation and design set forth herein. The inventions set forth herein are therefore not limited by the above described embodiments, methods, and examples, but extend to all embodiments and methods within the scope and spirit of the invention as claimed.

We claim:

1. A cap for a container, the cap configured for mounting over an opening in the container and for dispensing controlled quantities of items held in said container, wherein said cap has an upper surface, a lower end and a channel extending from the upper surface to the lower end, said channel providing a passageway through said cap and sized to allow for a predetermined quantity of items within the container to be transferred through an exit port in an upper portion of the cap to a space exterior to said cap, the cap further comprising:

a) a lid integral with and covering at least an upper portion of the cap, said lid moveable from a closed position to an open position by a hinged connection, the lid in its closed position preventing the dispensing of items from within the passageway and in its open position allowing dispensing of at least one item from within the passageway through the exit port, and b) a moveable gate that is operable, in a first orientation, to at least partially block the passageway to prevent movement of the item there through and, in a second orientation provided by movement of the lid to an open position, unblocking the passageway to allow a single item, or a preset multiple of items, to pass there through when the container with cap is oriented for content delivery.

2. The cap of claim 1 wherein the lid and gate interact so that when the lid is open the gate is in its first orientation and when the lid is closed the gate is in a its second orientation.

3. The cap of claim 1 wherein the lid, or a protrusion on a lower portion thereof, is in contact with a portion of the gate, or a protrusion therefrom, said contact between the lid and the gate, or protrusions therefrom, causing the gate to be held in its second orientation.

4. The cap of claim 3 wherein when the lid is in its open position there is no contact between the lid and the gate or protrusions therefrom.

5. The cap of claim 3 wherein when the lid is in other than its closed position or its open position the gate is intermediate between its first orientation and its second orientation.

6. The cap of claim 1 wherein the gate is biased toward its first orientation while the closed lid maintains the gate in its second orientation.

7. The cap of claim 6 wherein a spring is provided to bias the gate to its first orientation.

8. The cap of claim 6 wherein the gate is biased to its first orientation as an inherent function of the material of construction of the shape of the gate.

9. The cap of claim 1 wherein a lower portion of the lid is in contact with an upper portion of the gate, said contact between the lid and the gate causing the gate to be held in its second orientation.

10. The cap of claim 1 further including a deflector extending downward toward or into the container when the cap is applied to the container, said deflector at least partially obstructing the flow of items from the container into the passageway.

11. The cap of claim 1 wherein, following dispensing of an item or a preset multiple of items, each subsequent closing and opening of the lid allows a subsequent single item or a preset multiple of items to be dispensed.

12. A cap for a container, the cap configured for mounting over an opening in the container and for dispensing items held in said container, wherein said cap has an upper surface, a lower surface and a channel extending from the upper surface to the lower surface, said channel providing a passageway through said cap and sized to allow for items within the container to be transferred through an exit port in an upper portion of the cap to a space exterior to said cap, the cap further comprising an integral lid attached to and covering at least an upper portion of the cap, said lid moveable from a closed position to an open position, the lid in its closed position preventing the dispensing of items from within the passageway and in its open position allowing dispensing of no more than one item from within the passageway through the exit port wherein the lid has an integral gate portion extending into the channel when the lid is in its open position so as to block passage of items from the container through the channel, said integral gate portion positioned so as not to block the channel when the lid is in its closed position.

13. A cap for a container, the cap configured for mounting over an opening in the container and for dispensing controlled amounts of one or more items held in said container, wherein said cap has an upper surface, a lower surface and a channel extending from the upper surface to the lower surface, said channel providing a passageway through said cap and sized to allow for items from within the container to be transferred through an exit port in an upper portion of the cap to a space exterior to said cap, the cap further comprising:

a) a lid attached to, integral with and covering at least an upper portion of the cap, said lid moveable from a closed position to an open position through a hinged connection, the lid in its closed position preventing the dispensing of said items from within the passageway and in its open position allowing dispensing of at least one item from within the passageway through the exit port, and b) a deflector extending downward toward or into the container when the cap is applied to the container, said deflector at least partially obstructing the flow of items from the container into the passageway so as to at least partially block the passageway to prevent movement of the items there through to allow a single item or a preset multiple of items, to pass there through when the container with cap is oriented for content delivery.

14. The cap of claim 6 wherein gravity causes the gate to be biased to its first orientation.

15. A cap for a container, the cap configured for mounting over an opening in the container and for dispensing controlled quantities of items held in said container, wherein said cap has an upper surface, a lower end and a channel extending from the upper surface to the lower end, said channel providing a passageway through said cap and sized to allow for a predetermined quantity of items within the container to be transferred through an exit port in an upper portion of the cap to a space exterior to said cap, the cap further comprising:

a) a lid integral with and covering at least an upper portion of the cap, said lid moveable from a closed position to an open position by a hinged connection, the lid in its closed position preventing the dispensing of items from within the passageway and in its open position allowing dispensing of at least one item from within the passageway through the exit port, b) the lid having a gate portion integral therewith such that when the lid is in sealing engagement with the upper surface of the cap the gate portion extends into an interior portion of said cap without obstructing flow of items into said channel and rotation of the integral lid about the pivot point to eliminate the sealing engagement causes the gate portion to extend into the passageway so as to obstruct flow of items through the passageway.

* * * * *